US006769660B2

(12) United States Patent
DeLine

(10) Patent No.: US 6,769,660 B2
(45) Date of Patent: Aug. 3, 2004

(54) COMPRESSION ENHANCED SELF-INTERLOCKING HANGER SYSTEM

(75) Inventor: Kenneth E. DeLine, Fort Collins, CO (US)

(73) Assignee: Venture Management Alliance, LLC, Fort Collins, CO (US)

( * ) Notice: Subject to any disclaimer, the term of this patent is extended or adjusted under 35 U.S.C. 154(b) by 6 days.

(21) Appl. No.: 09/959,130

(22) PCT Filed: Mar. 23, 2001

(86) PCT No.: PCT/US01/09563

§ 371 (c)(1),
(2), (4) Date: Oct. 15, 2001

(87) PCT Pub. No.: WO01/72182

PCT Pub. Date: Oct. 4, 2001

(65) Prior Publication Data

US 2002/0179805 A1 Dec. 5, 2002

Related U.S. Application Data

(60) Provisional application No. 60/191,993, filed on Mar. 24, 2000.

(51) Int. Cl.[7] ..... F16M 13/00

(52) U.S. Cl. ..... 248/542; 248/476

(58) Field of Search ..... 248/476, 477, 248/485, 497, 542, 489, 495, 475.1, 479, 480

(56) References Cited

U.S. PATENT DOCUMENTS

| | | | | |
|---|---|---|---|---|
| 3,861,639 A | | 1/1975 | Morrill | 248/489 |
| 3,955,790 A | | 5/1976 | Ballin | 248/489 |
| 3,982,719 A | | 9/1976 | Kilborne | 248/489 |
| 4,026,510 A | | 5/1977 | Holmes | 248/493 |
| 4,069,998 A | | 1/1978 | Rytting | 248/476 |
| 4,171,117 A | | 10/1979 | Prochaska | 248/495 |
| 4,244,549 A | | 1/1981 | Oldfield | 248/494 |
| 4,333,625 A | | 6/1982 | Haug | 248/216.1 |
| 4,384,648 A | | 5/1983 | Hart et al. | 206/527 |
| D275,730 S | | 10/1984 | Melley | D8/373 |
| 4,641,807 A | | 2/1987 | Phillips | 248/480 |
| 4,645,165 A | | 2/1987 | Raap | 248/476 |
| 4,775,129 A | | 10/1988 | Gleisten | 248/493 |
| 4,883,247 A | | 11/1989 | Crandall | 248/542 |
| 5,048,788 A | | 9/1991 | Lorincz | 248/477 |
| 5,069,411 A | | 12/1991 | Murphy | 248/476 |
| 5,069,412 A | | 12/1991 | Jacob | 248/493 |
| D361,260 S | | 8/1995 | Trentham | D8/354 |
| 5,443,238 A | | 8/1995 | Mitchell | 248/498 |
| 5,507,462 A | | 4/1996 | Hickey | 248/489 |
| 5,749,558 A | * | 5/1998 | Wallo | 248/475.1 |
| 5,791,625 A | | 8/1998 | Orser | 248/495 |
| 5,816,557 A | * | 10/1998 | Tepper | 248/476 |
| 5,906,349 A | | 5/1999 | Roy | 248/489 |
| 5,947,438 A | | 9/1999 | Lemire | 248/476 |
| 6,062,525 A | * | 5/2000 | Lemire | 248/475.1 |
| 6,095,479 A | * | 8/2000 | Brindisi | 248/476 |
| 6,182,946 B1 | * | 2/2001 | Rutherford | 254/391 |

OTHER PUBLICATIONS

U.S. PCT patent application No. PCT/US01/09563, filed Mar. 23, 2001, entitled "Compression Enhanced Self–Interlocking Hanger System".

* cited by examiner

*Primary Examiner*—Kimberly Wood
*Assistant Examiner*—A. Joseph Wujciak
(74) *Attorney, Agent, or Firm*—Santegelo Law Offices, P.C.; Craig R. Miles

(57) ABSTRACT

An object hanger system provides multiple features that may be used independently or in combination to hang a variety of objects to a hanging surface (24). Interlocking hanger bodies (27) (28) allow the user to select from a variety of hanger technologies including, among others, two point, three point, or four point hanging systems. The hanger invention may comprise a hanger body (1) with an edge having a beveled surface (5) and a compression element (6) to resist movement of the interlocked hanger bodies.

17 Claims, 23 Drawing Sheets

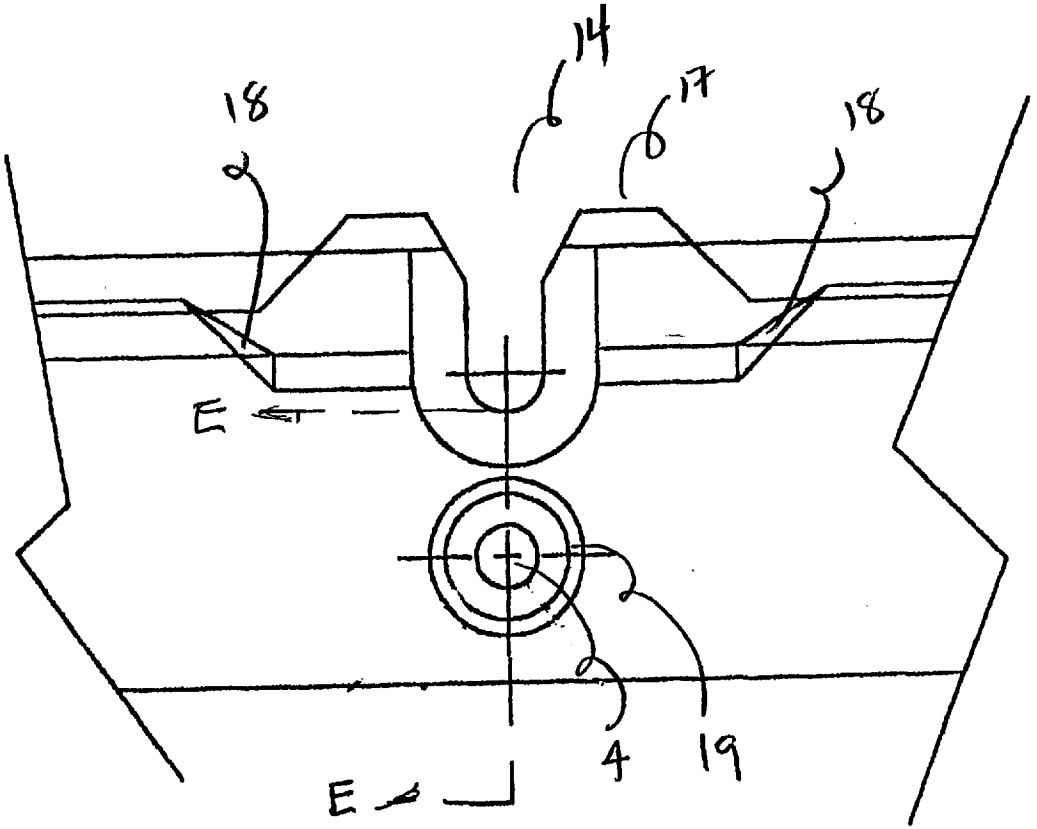
FIG 10
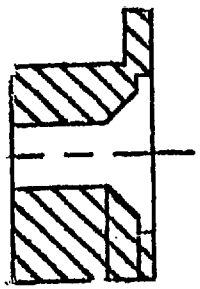
E-E

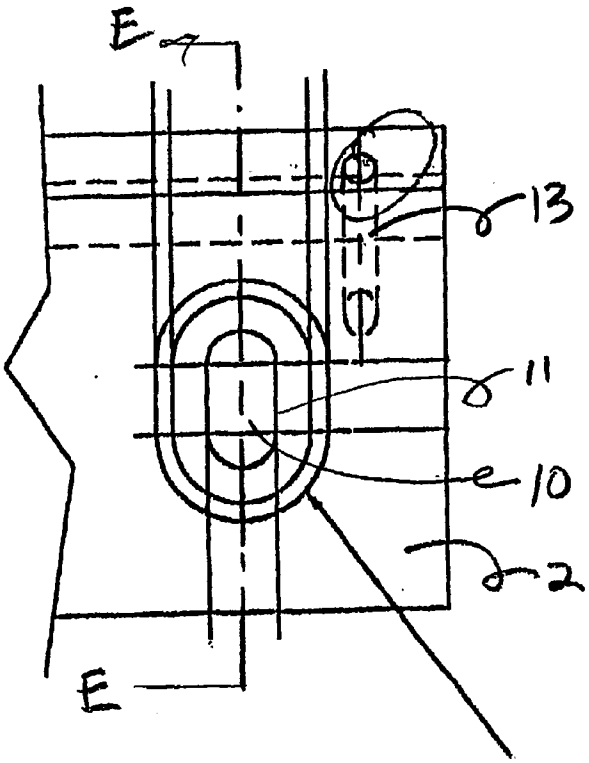
FIG 11
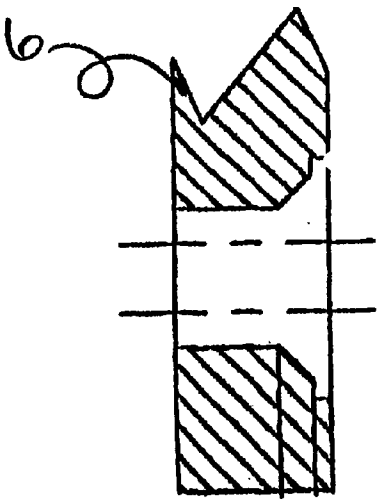

COMPRESSION ENHANCED SELF-INTERLOCKING HANGER SYSTEM

This application is the United States National Stage of International Application No. PCT/US01/09563, filed Mar. 23, 2001, which claims the benefit of U.S. Provisional Application No. 60/191,993, filed Mar. 24, 2000, each hereby incorporated by reference.

TECHNICAL FIELD

Generally, a hanger system that provides adjustable securement of objects to a hanging surface. Specifically, a hanger that may be used independently, interlocked with itself, or with other types of securement hardware or mechanical fasteners to hang objects.

BACKGROUND

Hanging objects so that they are positioned correctly can be a difficult, frustrating, and time consuming task. "A little to the left. No just a bit to the right. There. No wait. Just a teensy bit to your right." And so forth, until satisfaction is achieved. Or not "Oh just leave it!" For centuries people have been hanging a wide variety of objects such as fine art, mirrors, furniture, knick knacks, framed items, or the like to surfaces. At one time or another nearly every person will use a hanger to secure an object to a surface. Because there is a large commercial market for hanger devices, the manner of securing objects to surfaces has taken a variety of forms. In spite of the variety of hanger devices available to the consumer, substantial problems remain unresolved with respect to providing an object hanger that maintains objects in the desired orientation with respect to the hanging surface, and with respect to providing an object hanger that has a multiplex of hanger technologies in a single hanger device. As such, there remains a long felt, but unresolved need, for an object hanger that can be used to hang a variety of objects and which maintains the objects in a desired orientation with respect to the hanging surface.

A significant problem with conventional hanger devices may be that the suspension element is responsive to a single point hanger. Single point hangers encompass any object hanger which provides a single suspension point, or single support point, to which a portion of a suspension element is responsive. For example, a nail driven into the hanging surface provides a single point hanger. Other examples of single point hangers are disclosed by U.S. Pat. Nos. 5,507,462; 3,861,639; 4,641,807; 5,048,788; 5,906,349; and 4,026,510, hereby incorporated by reference. As can be understood, when the ends of a suspension element, such as a wire or a cord, are connected a distance apart to the object to be hung and when a portion of the suspension element is made responsive to a single point hanger, the suspension element forms a triangle. The base of the triangle can be defined by the distance between the two ends connected to the object and the two sides having an apex at the single point hanger. There may be no manner of adjusting the orientation of the object relative to the hanging surface but to change the length of the two sides of the triangle by moving the portion of the suspension element responsive to the single point hanger. If the object must be level with the horizon or parallel with an architectural line of a room (such as, the ceiling or floor) or other feature to which the objects orientation is made relative, it can be extremely difficult to find and position the exact portion of the suspension element that must be responsive to the single point hanger to orient the object properly.

Another significant problem with conventional hanger devices may be that they do not provide lateral or vertical adjustment of the object after it is hung. As discussed above, in most cases, the single point hanger only allows the orientation of the object relative to the hanging surface to be changed by adjusting the length of the suspension element defining the two sides of the triangle on either side of the apex defined by the single point hanger. The single point hanger typically does not allow for any other type of adjustment, such as lateral or vertical adjustment of the object. In some cases, where an attempt is made to provide additional adjustment, such as the hanger device disclosed by U.S. Pat. No. 4,645,165, hereby incorporated by reference, the problems associated with the use of a single point hanger are not also addressed. Other configurations of hanger devices, such as the hanger device disclosed by U.S. Pat. No. 4,171,117, hereby incorporated by reference, which may stabilize the orientation of objects relative to the hanging surface by providing rotatably adjustable interlocking pieces do not provide a manner of further adjustment of the object laterally or vertically.

Another significant problem with conventional hanger devices may be that the hanger devices do not provide sufficient compression of the suspension element or interlocking components to provide sufficient resistance to movement of the hung object. With respect to conventional single point hangers, insufficient friction may be placed on the suspension element to maintain the object in the desired orientation once hung. In some cases, even small differences in the weight of the object itself on either side of the single point hanger may be sufficient to allow the suspension element to move allowing the object to move from the desired orientation. With respect to other types of hangers, the weight of the object may be insufficient to develop sufficient frictional forces between conventional hanger components to maintain their relative positions.

Another significant problem with conventional hanger devices may be that they are comprised of multiple components designed to mate together have different configurations. Examples are disclosed by U.S. Pat. Nos. 361,260; 4,883,247; 5,443238; 4,069,998; 3,955,790; 4,645,165, and 4,171,117, hereby incorporated by reference. Thus, with respect to manufacturing these conventional hanger devices, separate tooling may be required to make each of the unique components. Moreover, these types of hanger devices may only function when mating these unique components together. Additionally, these types of hanger devices may have only limited application. For example, U.S. Pat. No. 5,443,238, hereby incorporated by reference, discloses a hanger device that mates only with a particular type of slotted frame backer material on an object.

Yet another significant problem with conventional hanger devices may be that they cannot be used for a multiple applications. As disclosed by U.S. Pat. Nos. 3,982,719; 4,244,549; 5,069,412; 4,333,625; and 275,730, hereby incorporated by reference, these conventional hanger devices can only be used when the suspension element is wire or cord-like. U.S. Pat. No. 4,384,648, hereby incorporated by reference, discloses a locator device for hanger devices that comprise a wire or cord-like suspension element and eyelets. U.S. Pat. No. 5,791,625, hereby incorporated by reference, may only be used with a saw-tooth hanging bracket.

Yet another problem with conventional hanger devices may be that they have too many components or may be difficult to use. For example, U.S. Pat. Nos. 4, 244,549; and 5,947,438, hereby incorporated by reference, discloses the use of a wire that must make a circuitous route through the hanger device to function properly. Alternately, as shown by U.S. Pat. No. 5,069,411, hereby incorporated by reference, the hanger device has numerous components to assemble prior to use.

With respect to making and using object hangers, the present invention discloses technology which addresses every one of the above-mentioned problems.

DISCLOSURE OF THE INVENTION

A broad object of the invention is to provide an object hanger system having features which assist in hanging objects on hanging surfaces in the desired orientation. The embodiments of the object hanger invention and the methods of hanging objects disclosed are varied and may be incorporated into a variety of hanger technologies used in numerous hanging applications. Naturally, as a result of these several different and potentially independent aspects of the invention, the specific objects of the invention are quite varied.

Moreover, as can be understood from the description, the hanger invention includes a variety of aspects which may result in various combinations and permutations of the invention. As such, embodiments of the invention should be understood to involve each aspect independently, in various combinations or permutations, or collectively to create a multi-purpose hanger system.

A significant object of embodiments of the invention can be to provide a dual point hanger system. The dual point hanger system addresses the problems with respect to single point hangers as discussed above. The dual point hanger system can eliminate or minimize the effort required to make fine adjustments to the suspension elements (wires, cords, sawtooth elements, or the like) responsive to a single point hanger and can provide frictional surfaces or compression surfaces to resist displacement of the hung object from the desired orientation.

Another significant object of embodiments of the invention can be to provide an interlocking embodiment of the hanger invention. The interlocking embodiment of the invention can be used in various manners to provide three point, four point, or modified sawtooth hanging systems, among others.

Another significant object of embodiments of the invention can be to provide a three point hanger system. The three point hanging system provides a manner of hanging an object without the use of a wire, cord, or saw-tooth suspension element, or the like. The three point hanging system can also provide additional rotational and lateral adjustment of the object relative to the hanging surface.

Another significant object of embodiments of the invention can be to provide a four point hanger system The four point hanger system provides enhanced stability with respect to hanging larger objects or asymmetrical objects which require fine rotational and lateral adjustments with respect to the hanging surface.

Another object of embodiments of the invention can be to provide interlocking elements. In these embodiments of the invention, the hanger can be used with itself in the three point or four point hanger systems described above. The interlocking embodiments of the invention provide a stable manner to hang an object. Another benefit of using the interlocking embodiments of the invention can be that the hung objects will stay close to the hanging surface. When wire or cord-like suspension elements are used the objects tend to lean away from the wall.

Another significant object of embodiments of the invention can be to provide compression elements. One aspect of providing compression elements can be to increase friction between a suspension element, such as a wire or cord, and the hanger. A second aspect of providing compression elements can be to increase the frictional surface area between hangers used in the interlocking embodiment of the invention. A third aspect of providing compression elements can be to increase the friction between two surfaces. As to each of these, the compression aspects of the invention to resist the movement of the object hung.

Another embodiment of the invention can be to provide a multi-purpose hanger system. In a single configuration, the instant hanger invention can provide features compatible with numerous types of conventional hanger devices and hanger hardware such as wire, nails, screws, or saw-tooth hangers, to name a few; or can be compatible with itself in the interlocking embodiment of the invention.

Naturally, further independent objects of the invention are disclosed throughout other areas of the specification and drawings.

BRIEF DESCRIPTION OF THE DRAWINGS

FIG. 10 shows a cross section of a particular embodiment of a mechanical fastener interpenetration element having a mechanical fastener recess element.

FIG. 11 shows a cross section of a particular embodiment of a mechanical fasterner interpenetration element having an adjustable rotation element.

MODE(S) FOR CARRYING OUT THE INVENTION

The invention constitutes a hanger system and the methods which disclose how to make and how to use compression enhanced self-interlocking hanger system technology. The hanger invention satisfies a long felt need for a hanger system which assists in orienting objects relative to a hanging surface, and further helps to maintain the desired orientation of objects. Some of the various embodiments of the invention are described below.

Figure 1:
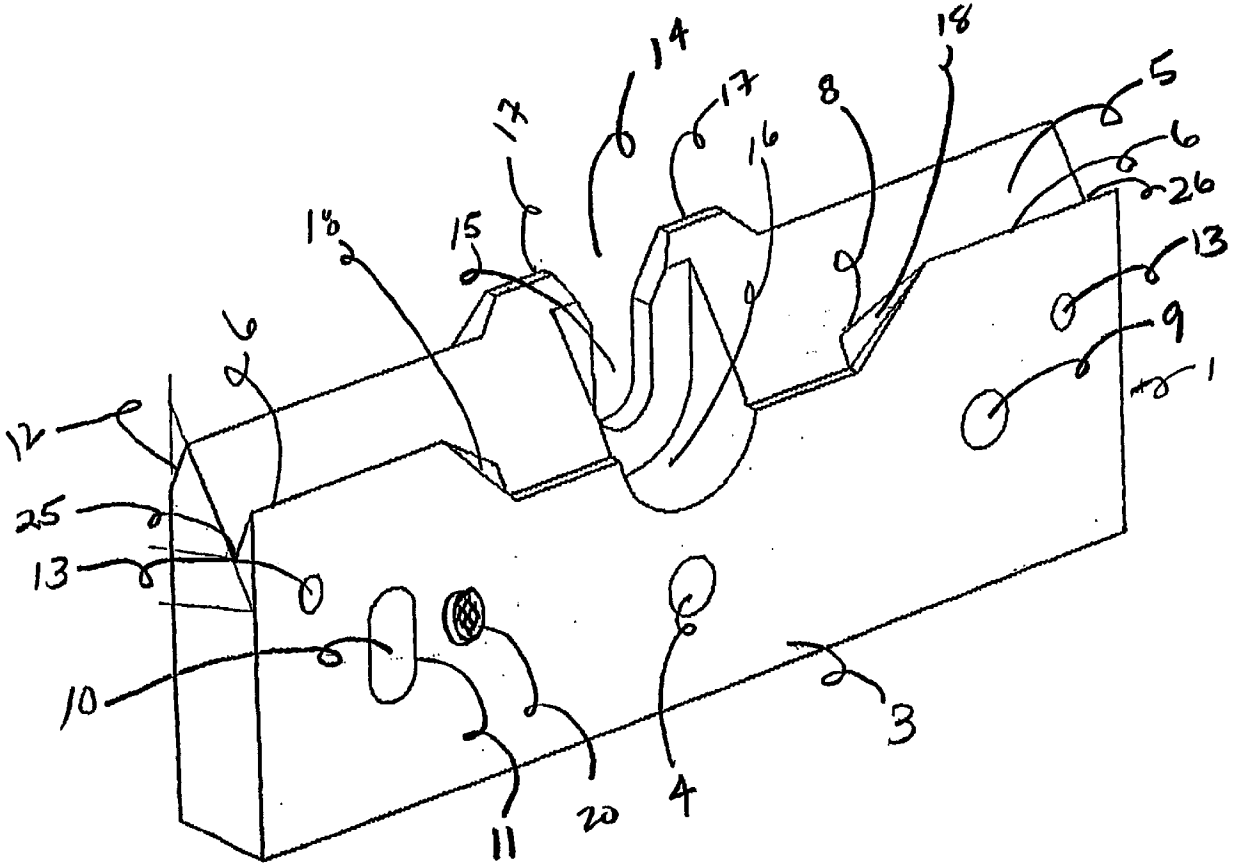
FIG. 1 shows a perspective view of the back side of a particular embodiment of the hanger invention.
Figure 2:
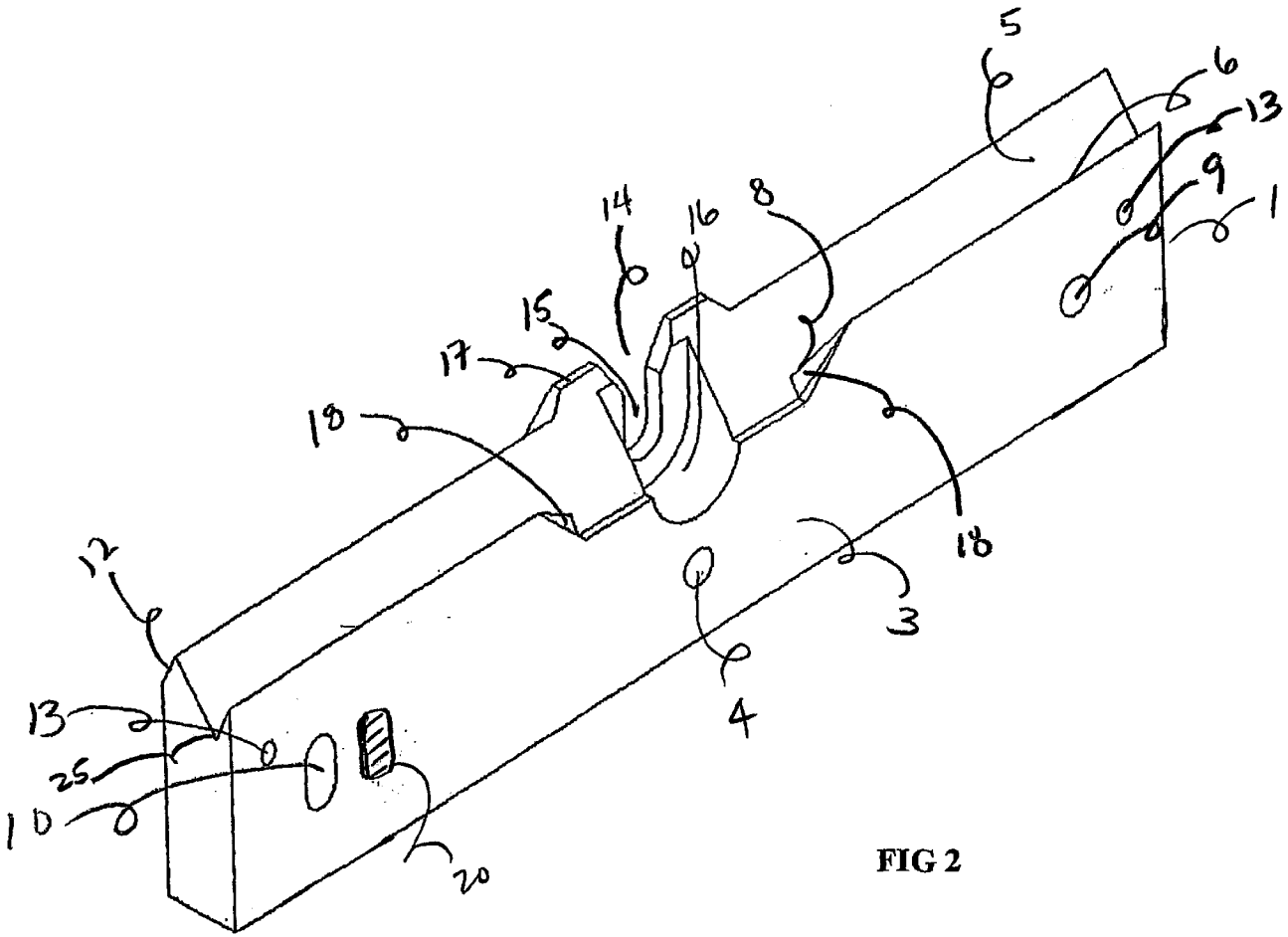
FIG. 2 shows a perspective view of the back side of a particular embodiment of the hanger invention.

Referring first to FIGS. 1 through 4, a basic embodiment of the hanger invention can comprise a hanger body (1). As illustrated in FIGS. 1 and 2, the hanger body (1) can be rectangular in configuration having a variable height, width, or depth depending on the application. However, the figures should not to be construed as limiting the configuration of the hanger body (1) the illustrated configurations and other polygonal or non-polygonal configurations could be employed using various elements and aspects of the invention described below. The hanger body (1) can be made from any material which may be molded or otherwise configured to provide the various elements disclosed. Materials, including, but not limited to, wood, metal, or plastic can be used The front surface (2) and the back surface (3) of the hanger body (1) can communicate through at least one mechanical fastener interpenetration element (4). The size and shape of mechanical fastener interpenetration element can vary to accomadate numerous types of mechanical fasteners, such as nails, screws, bolts, molly fasteners, expansion fasteners, or the like.

Figure 7:
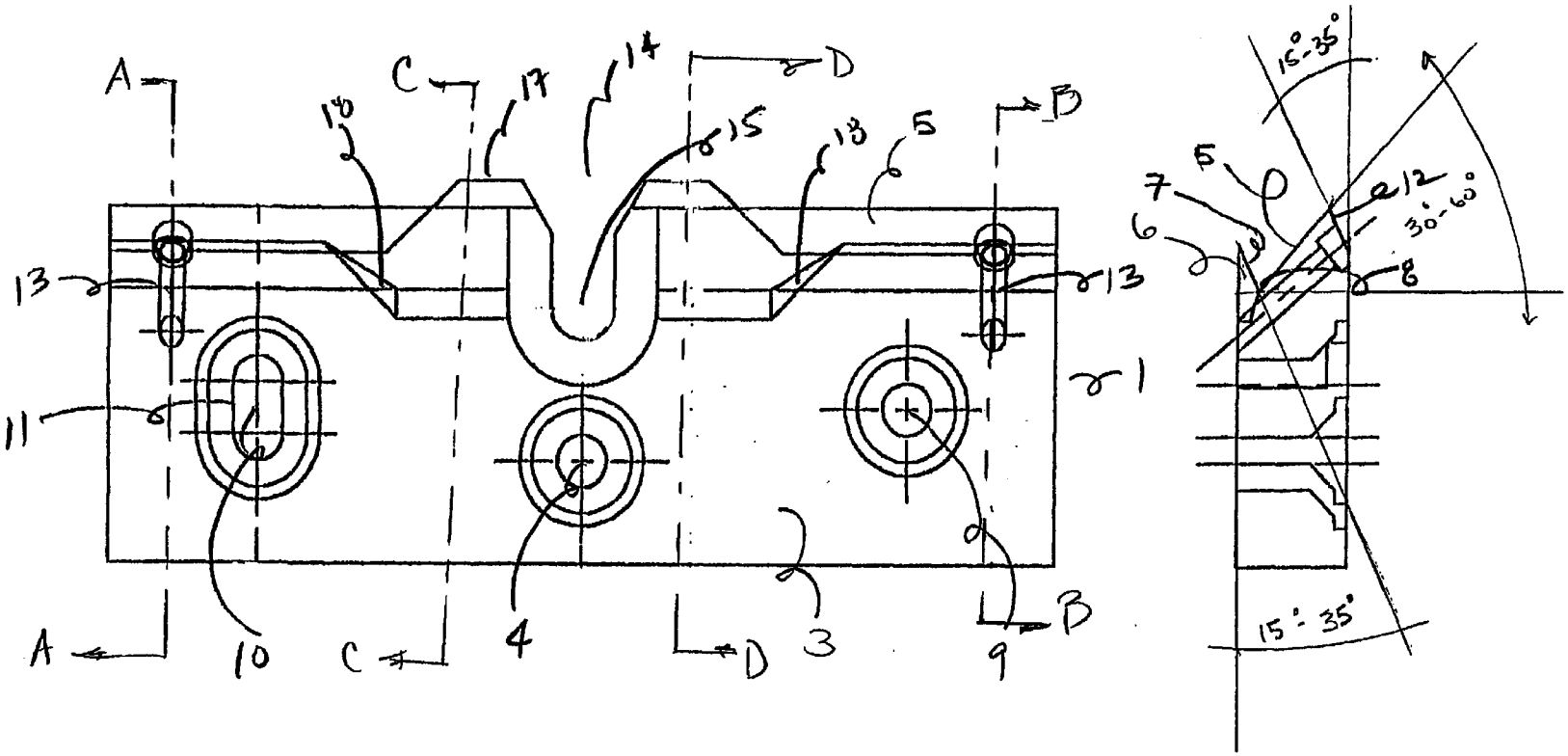
FIG. 7 shows a back view and an end view of a particular embodiment of the invention.

The hanger invention may also comprise a hanger body edge having a beveled surface (5). The dimensions of the beveled surface, the inclination of the bevel surface, and the surface area of the beveled surface may be adjusted from application to application. The inclination of the beveled surface (5) can typically range between about 30 degrees to about 60 degrees from perpendicular with the back surface, as shown in FIG. 7. Certain applications may require greater or less inclination.

The hanger invention can also include a compression element (6) coupled to the beveled surface. The compression element (6) may be a continuous compression element positioned along the entire length of the beveled surface (5), or the compression element may comprise a pair of compression elements (6) as shown in FIGS. 1–6. Where the compression element is configured as a pair of compression elements the actual width of each compression element of the pair may vary in length. In some embodiments of the invention, each of the pair of compression elements (6) may be distal from each other having a location at or near the ends of the hanger body (1). The compression element can further comprise an inclined surface (7) as shown on FIGS. 3, 6, or 7. The angle of the inclined surface (7) may vary from application to application Typically, the angle of the inclined surface (7) can be between 15 degrees to about 30 degrees, as shown by FIG. 7.

The intersection of the planes of the beveled surface (5) and the inclined surface (7) can provide a compression groove (8). The compression groove can compress a wire-like or cord-like suspension element (21), such as the type illustrated in FIG. 14.

A second mechanical fastener interpenetration element (9) that communicates between the front surface (2) and the back surface (3) can define a rotation axis of a mechanical fastener. A third mechanical fastener interpenetration element (10) can have a location a distance from the second mechanical fastener interpenetration element (9). The invention can further comprise a rotation adjustment element (11) coupled to the third mechanical fastener interpenetration element. The rotation adjustment element (11) can allow the third mechanical interpenetration element (10) to rotate with respect to the rotation axis defined by the second mechanical fastener interpenetration element (9). Each of the various mechanical fastener interpenetration elements can further comprise a mechanical fastener recess elements (19).

Figure 3:
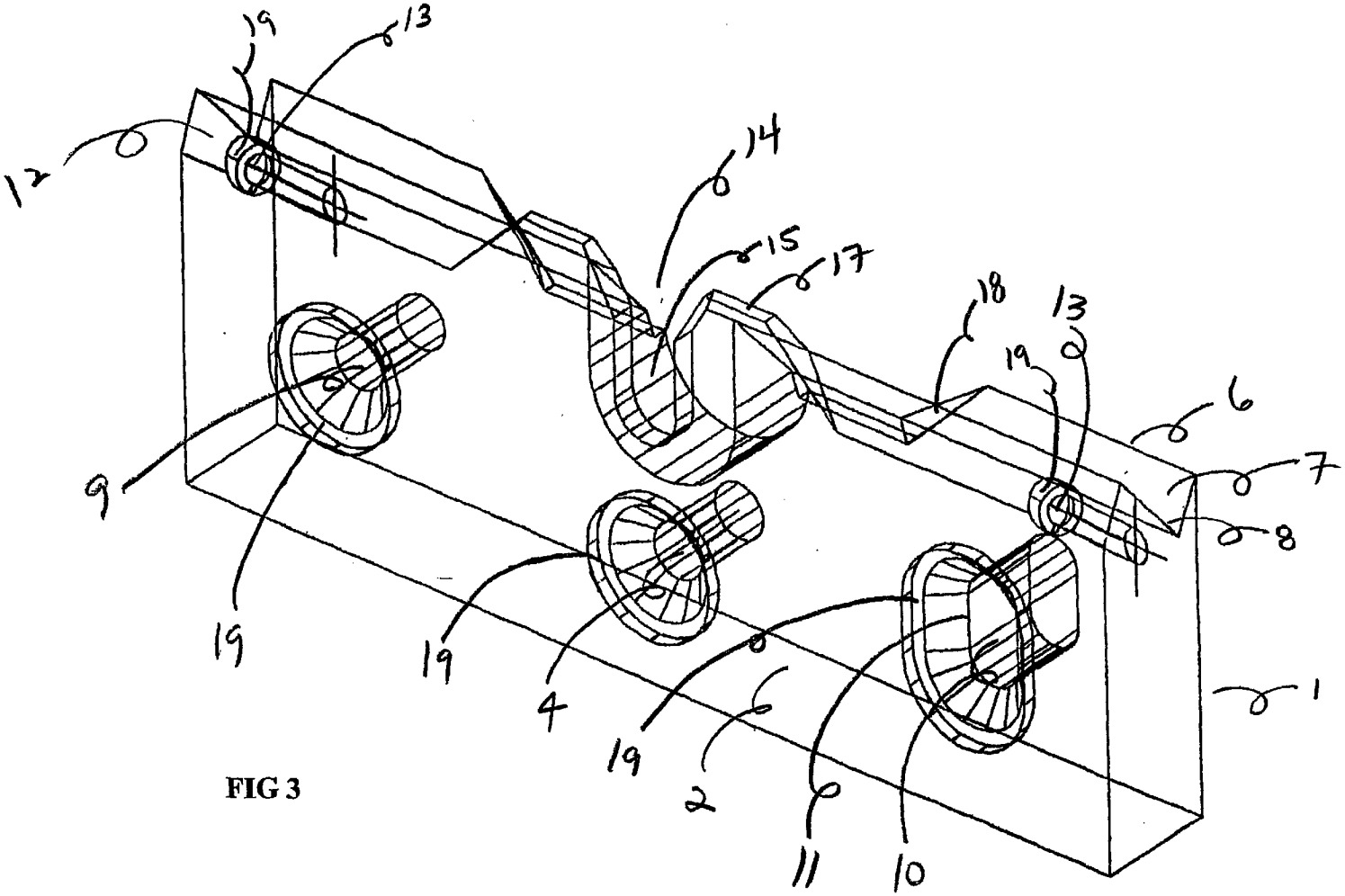
FIG. 3 shows a perspective view of the front side of a particular embodiment of the invention.
Figure 4:
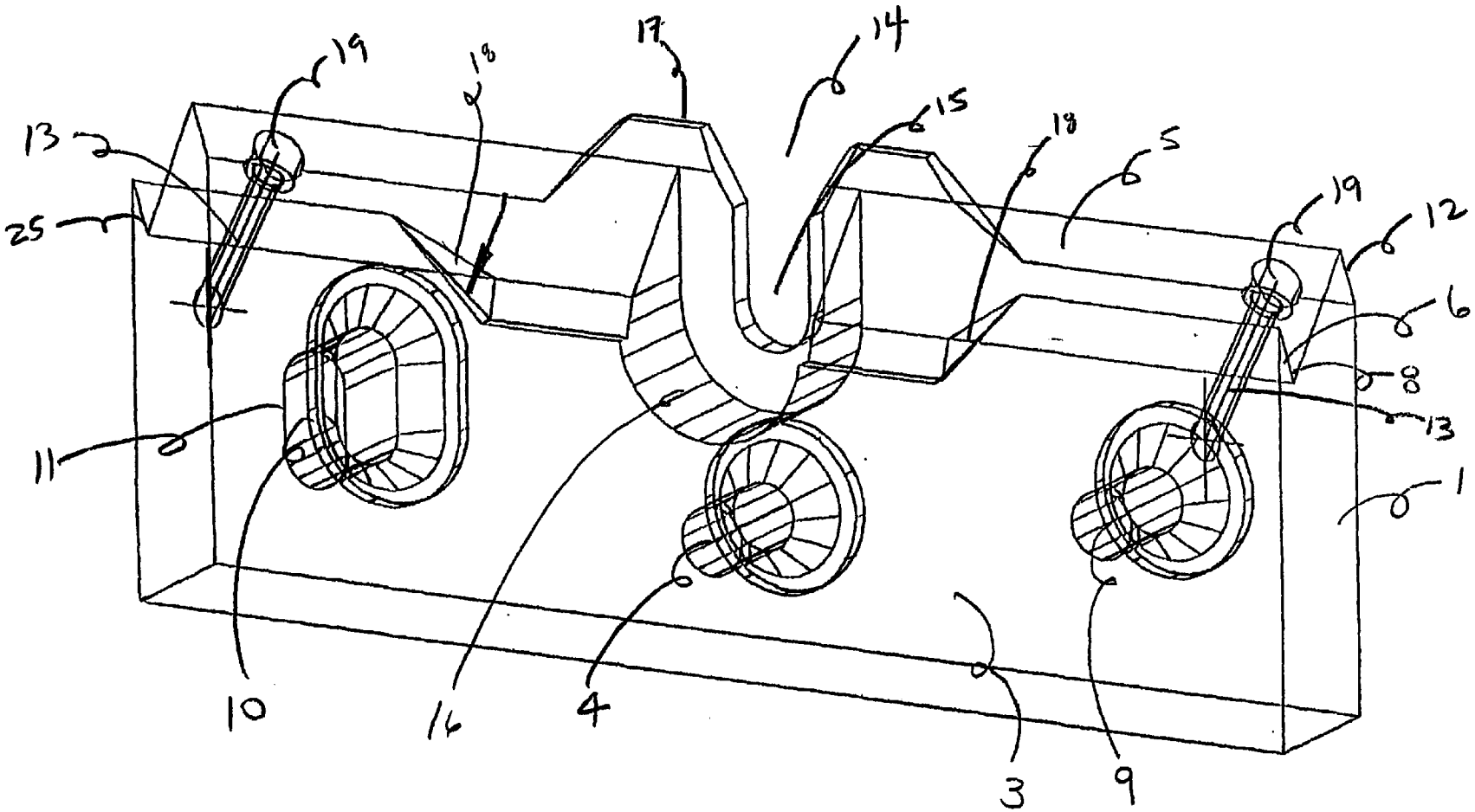
FIG. 4 shows a perspective view of the back side of a particular embodiment of the invention.
Figure 5:
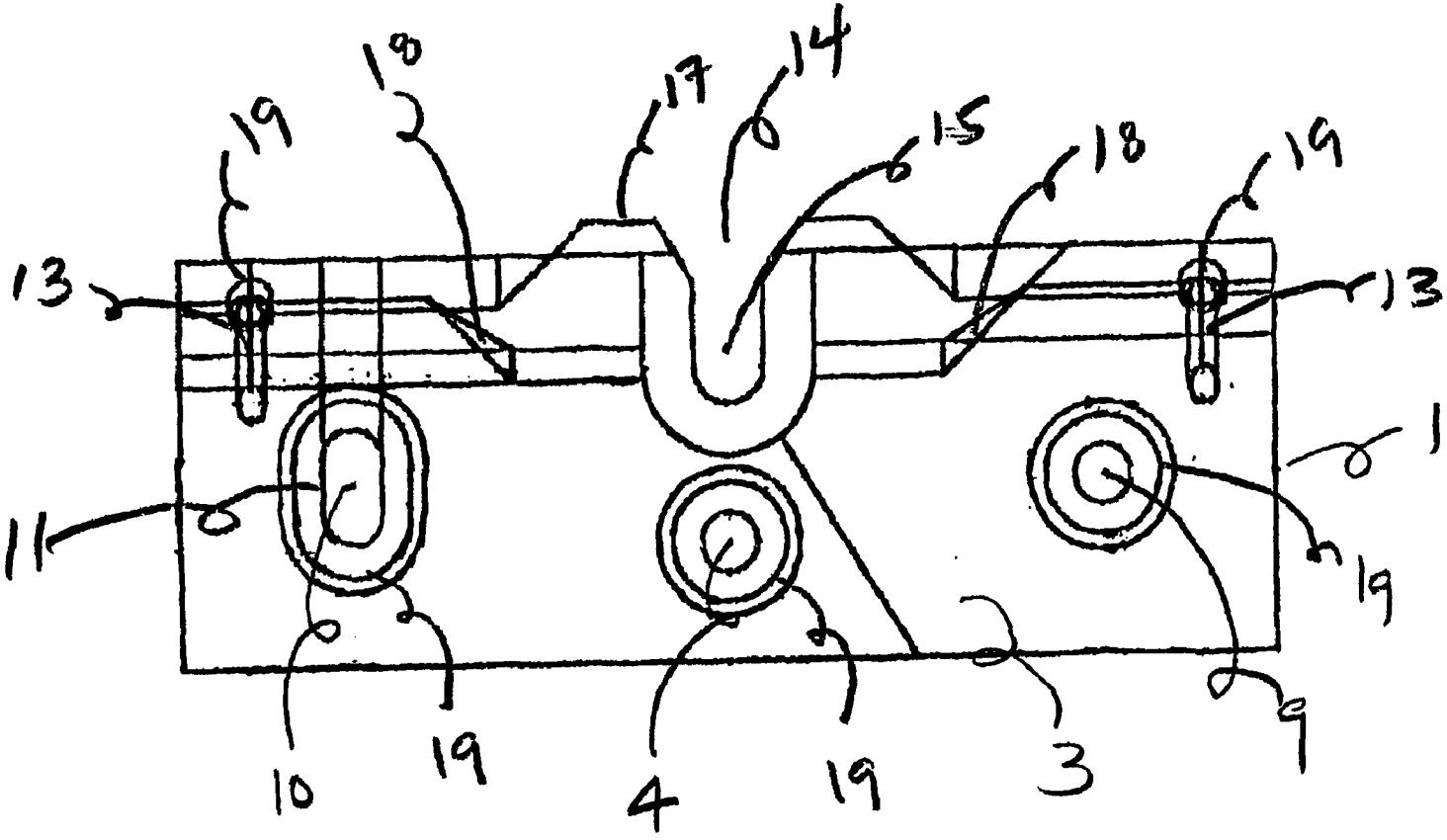
FIG. 5 shows a back view of a particular embodiment of the invention.
Figure 6:
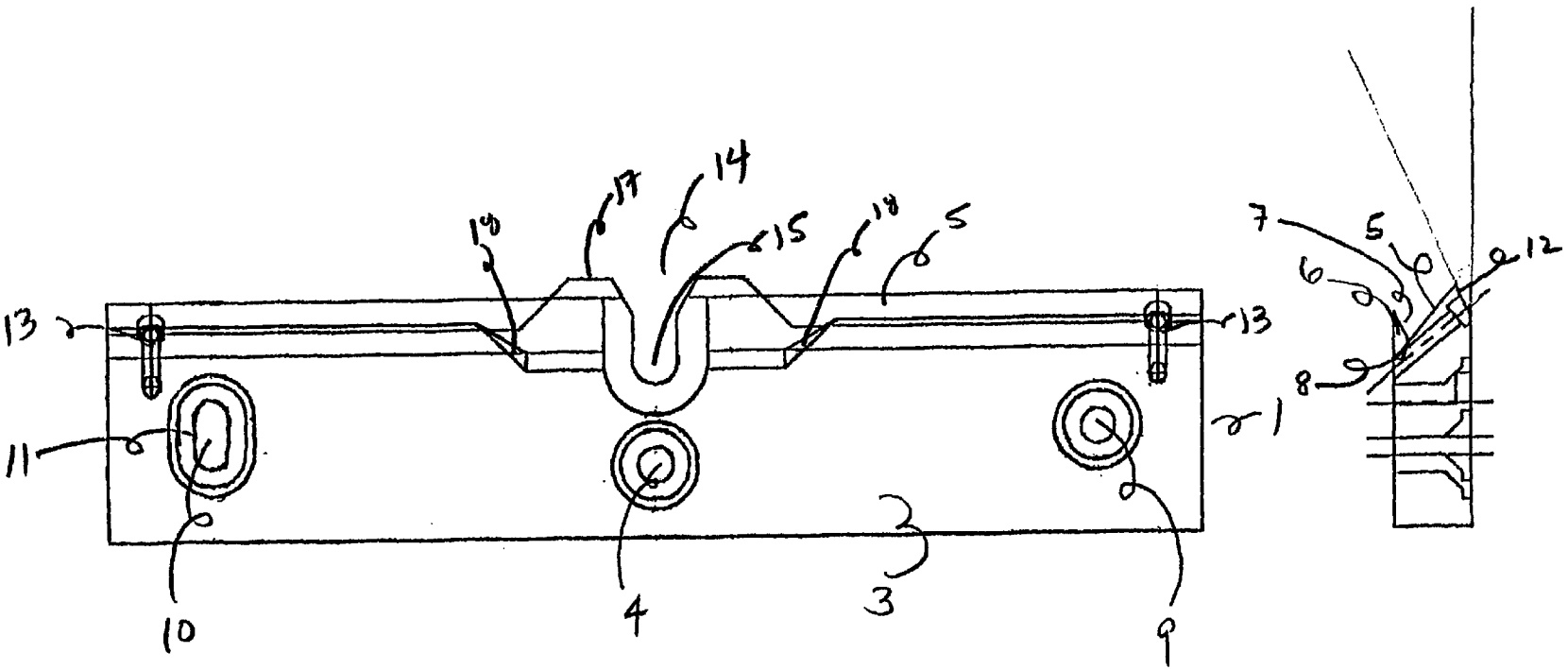
FIG. 6 shows a back view and an end view of a particular embodiment of the invention.

Certain embodiments of the invention may also include an inclined strike surface (12) as shown by FIGS. 3, 6, and 7. The inclined strike surface (12) intersects the planes of both the front surface (2) of the hanger body (1) and the beveled surface (5) of the hanger body edge. The inclined strike surface (12) can vary in size, inclination, or surface area depending on the application. The inclination of the inclined strike surface (12) can vary with respect the hanger body front surface (2) but can typically be between about 15 degrees to about 35 degrees, as shown in FIG. 7. Certain applications may require an inclination outside this range. The inclined strike surface (12) can further comprise at least one strike surface mechanical fastener interpenetration element (13). While the strike surface mechanical fastener interpenetration elements shown by the figures are configured for a finish nail, the strike surface mechanical fastener interpenetration element (13) could be configured for a variety of mechanical fasteners. The inclined strike surface (12) provides access for the tool used to set the mechanical fasteners responsive to the strike surface mechanical fastener interpenetration elements (13). For example, if a nail is used, the inclined strike surface allows the head of the nail to be driven into the recess element (19).

Some embodiments of the hanger invention may further comprise a mechanical fastener securement device (14). The mechanical fastener securement device can comprise an interpenetration between the front surface (2) and the back surface (3) of the hanger body (1) at a location where the interpenetration has a open perimeter at a point along the beveled surface (5). As shown in FIGS. 1–7, the open perimeter interpenetration can comprise a vertical slot (15). The dimensions of, or shape of, the open perimeter interpenetration could vary depending on the application. The mechanical fastener securement device (14) could further comprise a recess (16) defined by the back surface (3) of the hanger body (1). The recess (16) can be substantially aligned with the axis of the interpenetration of the mechanical fastener securement device.

The hanger invention can also comprise a lateral adjustment projection (17) coupled to the beveled surface (5) of the hanger body (1). The lateral adjustment projection (17) can be a single projection, or as shown in FIGS. 1–7, can be bifurcated by the open perimeter interpenetration or slot (15) of the mechanical fastener securement device (14). In some embodiments of the invention, a pair of lateral adjustment stops (18) can be coupled to the beveled surface (5) or can be configured as part of the compression element (6). In the interlocking embodiment of the invention the lateral adjustment projection (17) can travel between the two lateral adjustment stops (18).

Some embodiments of the invention can further include a friction augmentation element (20) located on the back side (3) of the hanger body, as shown in FIGS. 1 and 2. The friction augmentation element (20) can be a made from different type of material than the hanger body (1) or can be the same material as the hanger body (1). The friction augmentation element (20) can be a separately applied material or can be a integral component of a unitized hanger. The surface of the function augmentation element (20) can be textured or smooth so long as it provides the desired amount of enhanced friction between the back surface (3) of the hanger body (1) and the hanging surface.

Figure 8:
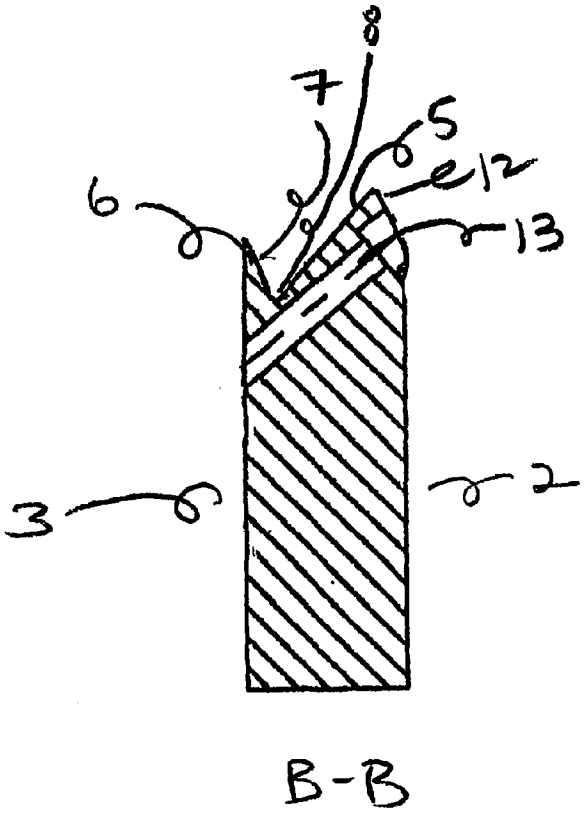
FIG. 8 shows two cross sections through a particular embodiment of a mechanical fastener interpenetration elements coordinated with an inclined strike surface.
Figure 8:
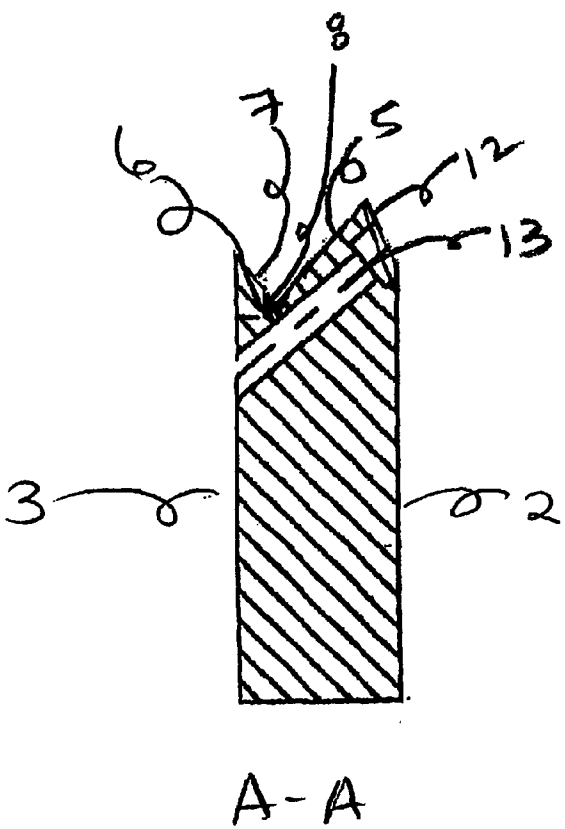
Figure 9:
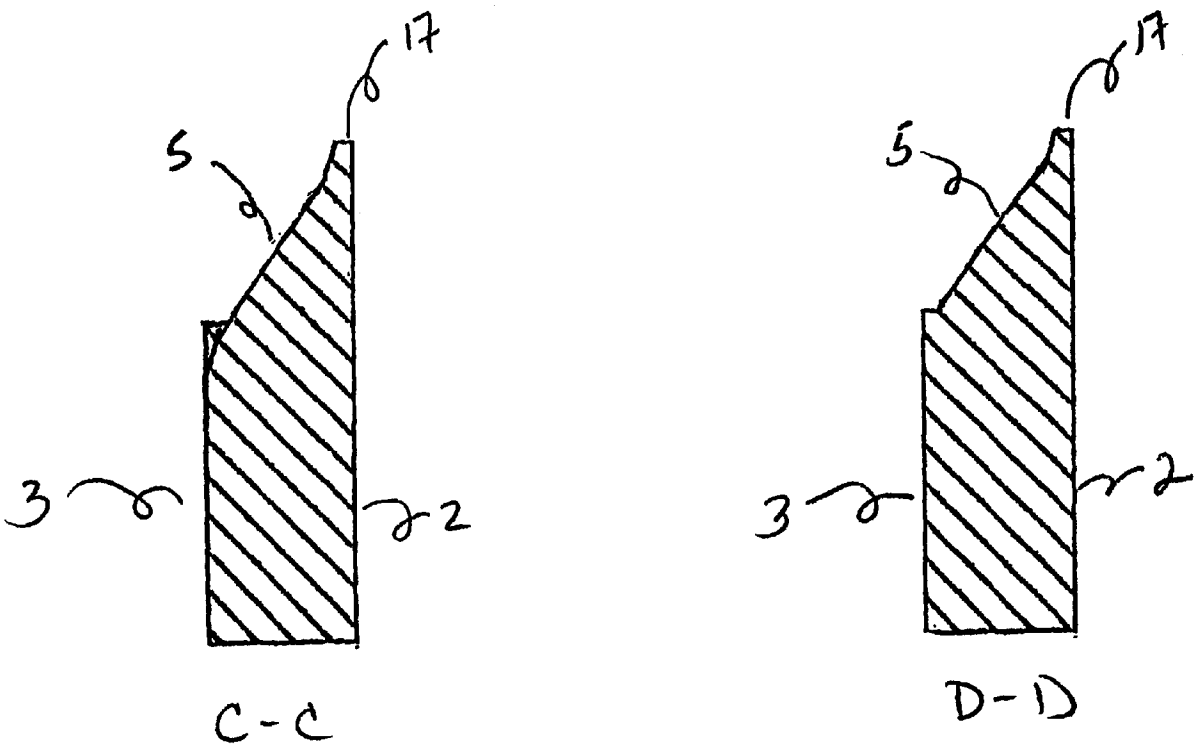
FIG. 9 shows two cross sections through a particular embodiment of a lateral adjustment projection.

Now referring to FIGS. 8–11, cross section views further disclose various elements of compression enhanced self-interlocking hanger technology. FIG. 8 details an embodiment of the inclined strike surface (12) and strike surface mechanical fastener interpenetration element (13). FIG. 9 details an embodiment of the lateral adjustment projection element (17) FIG. 10 details an embodiment of the mechanical fastener interpenetration element (4). FIG. 11 details an embodiment of the third mechanical fastener interpenetration (10) element further comprising the rotation adjustment element (11).

Figure 12:
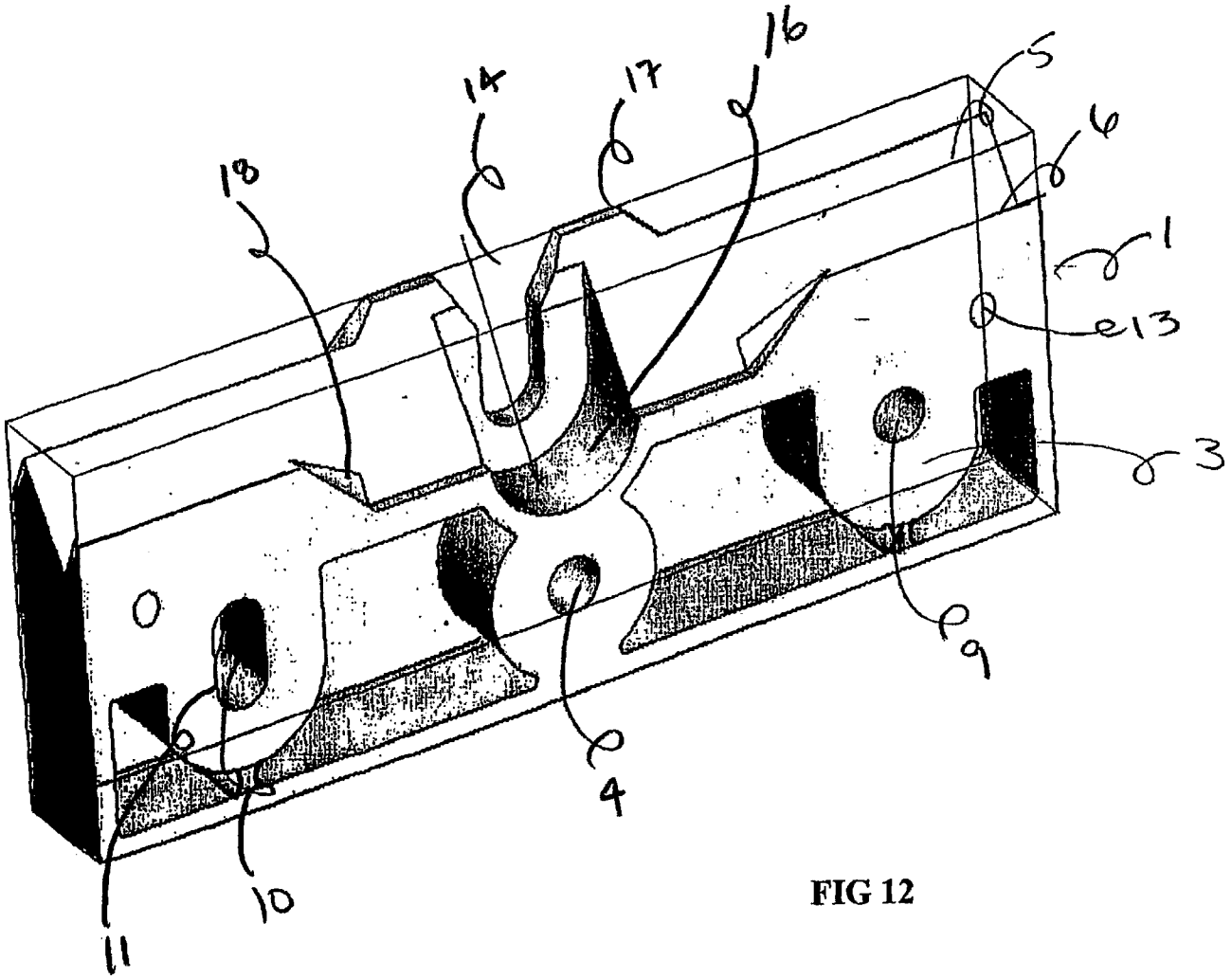
FIG. 12 shows a perspective view of the back side of a particular embodiment of the invention having a particular injection molding configuration.
Figure 13:
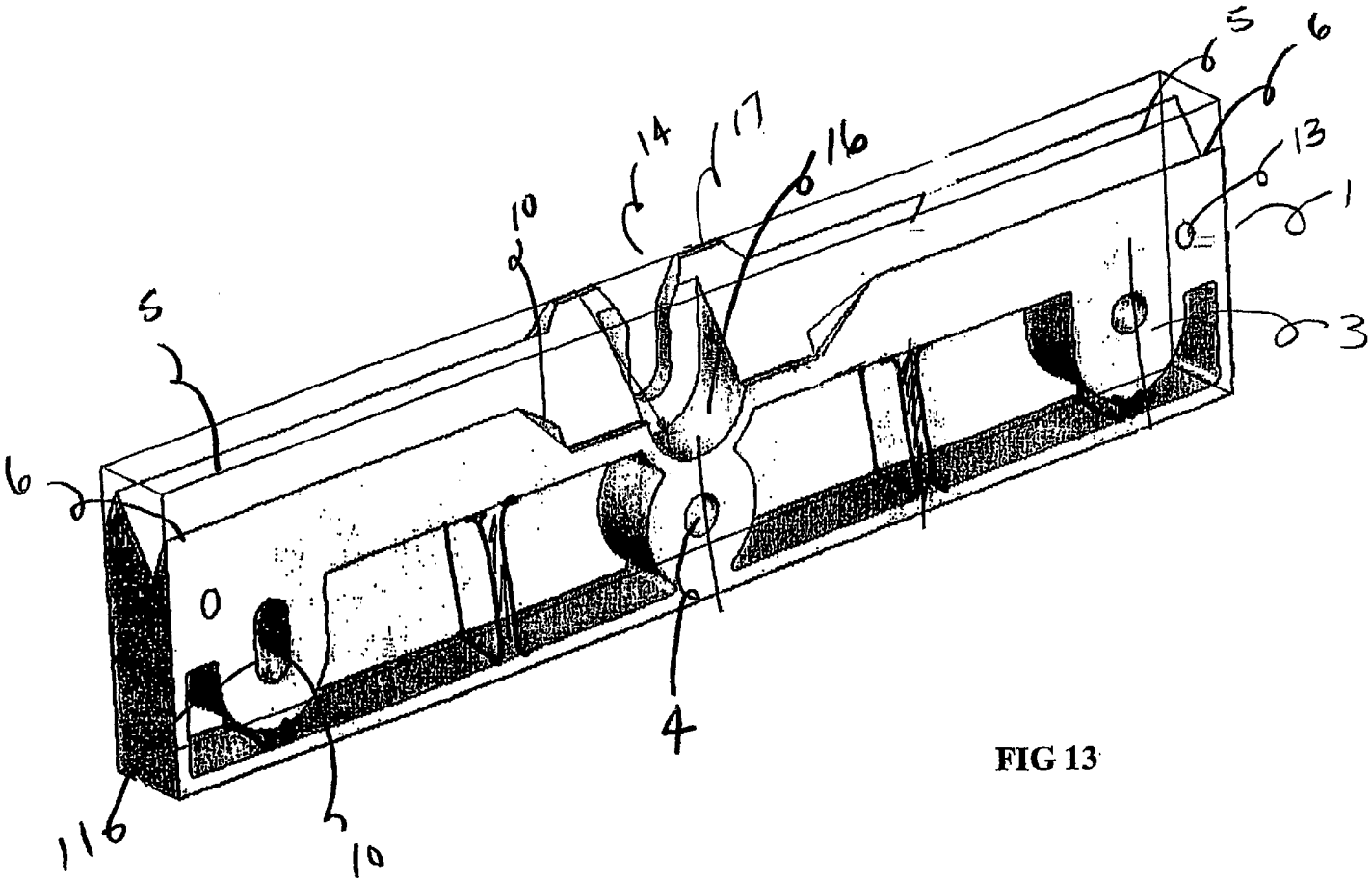
FIG. 13 shows, a perspective view of the back side of a particular embodiment of the invention having a particular injection molding configuration.

Now referring to FIGS. 12 and 13, configurations for injection molding the hanger body (1) are illustrated. The injection molding configurations reduce the amount of plastic used in forming the hanger body (1) and the various elements described above. The configurations also allow the hanger body to cool evenly after being released from the mold to minimize warp. Naturally, various molding configurations can be used and the figures are not intended to limit the configurations to the two configurations shown.

Dual Point Hanger System. Now referring to FIG. 14, many objects to be hung such as pictures, mirrors, or the like, use a suspension element (21) such as a cord, wire, or similar material. The suspension element has a first end (22) and a second end (23) connected to the object to be hung. An object hanger comprising a hanger body (1) having a hanger body edge with a beveled surface (5) and at least one compression element (6) (which could be a continuous compression element, a discontinuous compression element, or a pair of discontinuous compression elements as discussed above) can be mounted to a hanging surface (24). Mounting can be accomplished with a mechanical fastener (30) responsive to mechanical fastener interpenetration element (4).

A dual point suspension location coordinator can be made responsive to suspension element (21). The dual point suspension location coordinator can comprise a first suspensory element (25), a second suspensory element (26), and a rotation axis approximately equidistant between the first suspensory element and the second suspensory element defined by the mechanical fastener interpenetration element (4) responsive to the mechanical fastener (30). The hanger body (1) can rotate pivotally about the rotation axis to adjust the location coordinates of the first suspensory element (25) and the second suspensory element (26). Importantly, the location coordinates of the first suspensory element (25) and the second suspensory element (26) are coupled. That is, the location coordinates of the first suspensory element (25) traverse an arc of approximately equal circumference and length but in opposite direction with respect to the location coordinates of the second suspensory element (26).

The suspension element (21) can be positioned between the beveled surface and the compression element (6). In some embodiments of the dual hanger system invention, the suspension element (21) can be guided down the inclined surface (7) of the compression element and positioned into a compression groove (8). The compression groove (8) enhances the application of frictional forces of the beveled (5) and inclined (7) surfaces to the surface of the suspension element (21). The enhanced application of frictional forces assists in holding the suspension element (21) in its desired location. The compression element (6) also locates the suspension element (21) away from the hanging surface (24) so that the entire weight of the object can be held by the dual point hanger system which assists in maintaining the desired orientation of the object relative to the hanging surface (24).

The dual point hanging system allows for substantial adjustment of the dual point suspension location coordinator to orient the object relative to the hanging surface (24). The dual point suspension location coordinator can be adjusted up to about 45 degrees off level with the horizon and the first suspensory element (25) and the second suspensory element (26) will still function as a first suspension point and a second suspension point for the suspension element (21). As can be understood, the dual point suspension location coordinator simultaneously locates the proper coordinates of the first suspensory element (25) and the second suspensory element (26) allowing fine adjustment of the orientation of the object with reduced effort. Even if the portion of the suspension element (21) that is made responsive to the hanger body (1) or the compression groove (8) (depending on the embodiment of the invention used) would not orient the object level in a single point hanger system, the dual point suspension location coordinator rotates under the weight of the object to a orientation that can be substantially level with the horizon.

Interlocking Hanger System. Now referring to FIG. 15, an embodiment of the invention provides a manner of interlocking a first hanger (27) and a second hanger (28) Regardless of the number of elements which make up the interlocking embodiment of the invention, the first hanger (27) and the second hanger (28) can have substantially identical configurations. As such, the first hanger (27) and the second hanger (28) can each comprise a hanger body (1) having a front surface (2) and a back surface (3), a hanger body edge having a beveled surface (5), a first mechanical fastener interpenetration element (4) or (9) which communicates between the front surface (2) and the back surface (3), a lateral adjustment projection (17), and a pair of lateral adjustment stops (18).

In some embodiments of the invention, the first hanger (27) and the second hanger (28) can further include a second mechanical fastener interpenetration element (10). In this embodiment of the interlocking invention, the first mechanical fastener interpenetration element (9) can define a rotation axis and the second mechanical interpenetration element can further comprise a rotation adjustment element (11) which allows the first hanger (27) and the second hanger (28) to be rotatably adjusted relative to the hanging surface or the object surface. The mechanical fastener interpenetration elements can also include mechanical fastener recess elements (19).

The first hanger (27) and the second hanger (28) may also include a compression element (6) and an inclined strike surface (12). As discussed above the compression element (6) can be continuous or as shown in FIG. 1 can comprise a pair of compression elements (6) set abutting the lateral adjustment stops (18). The angle of the inclined strike surface (12) can be configured to mate with the inclined surface (7) of compression element (6) when the first hanger (27) and the second hanger (27) are interlocked The mating of these two inclined surfaces, as discussed above, provides a mated pair of friction surfaces in addition to the beveled surfaces (5). Not only does this manner of interlocking create additional friction surface area but also compresses the beveled surfaces (5) and the inclined surfaces (7) and (12) together to increase the friction between the surfaces. The increased friction surface area and the compression of the surfaces acts to resist movement of the first hanger (27) with respect to the second hanger (28).

The interlocking embodiment of the invention can also include friction augmentation elements (20) on the back side (3) of the hanger body (1).

The first hanger body (27) and the second hanger body (28) can also include elements which interlock but which are not used in the interlocked embodiment of the invention. For example, the first hanger body (27) and the second hanger body (28) can include the mechanical fastener securement element (14) as described above.

Figure 15:
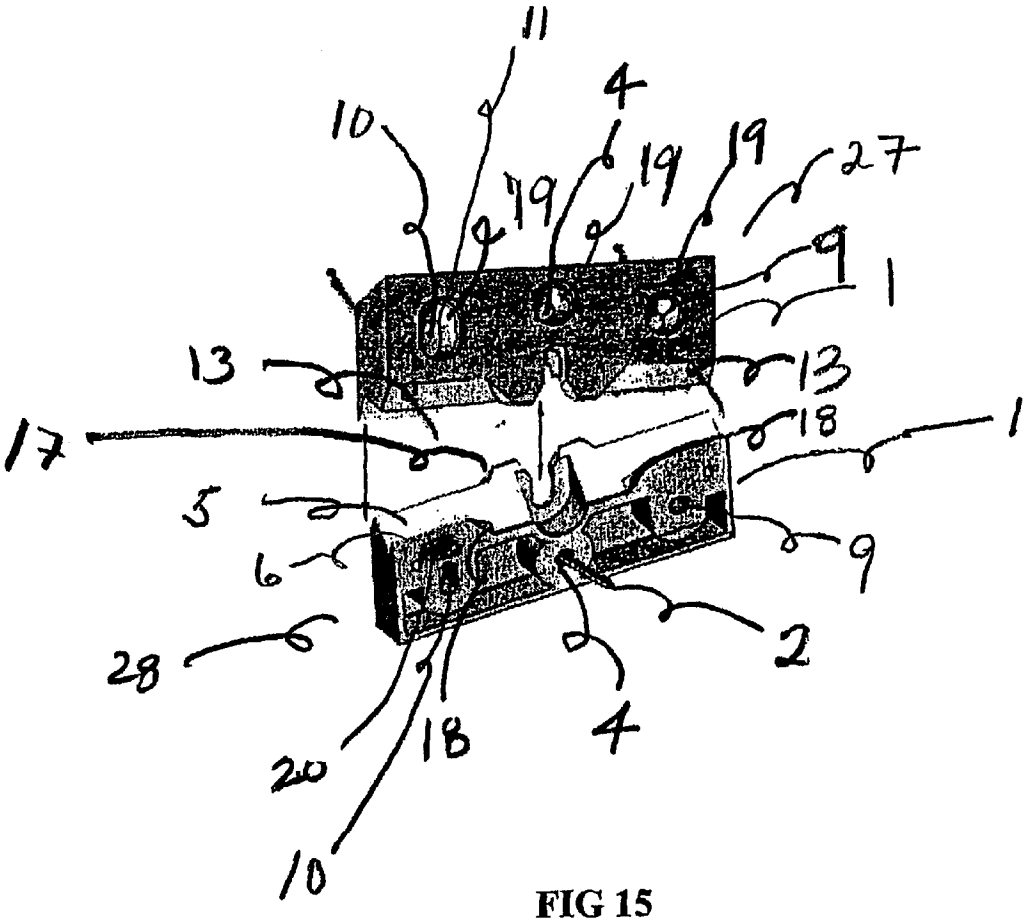
FIG. 15 shows a particular embodiment of the interlocking embodiment of the invention.

Three Point Hanger System. Now referring to FIGS. 15–17, an embodiment of a three point hanger system is shown Generally, the three point hanger system comprises the use of a first hanger (27) and a second hanger (28) as shown in FIG. 15. The first hanger (27) comprises a hanger body (1) having a hanger body edge with a beveled surface (5). The first hanger (27) is mounted to the object surface so that the orientation of the first hanger remains fixed relative to the object surface. Fixing the orientation of the first hanger relative to the object surface can comprise the use of the strike surface mechanical interpenetration elements (13), or use of a first mechanical fastener interpenetration element (9) and the second mechanical fastener interpenetration element (10).

Figure 14:
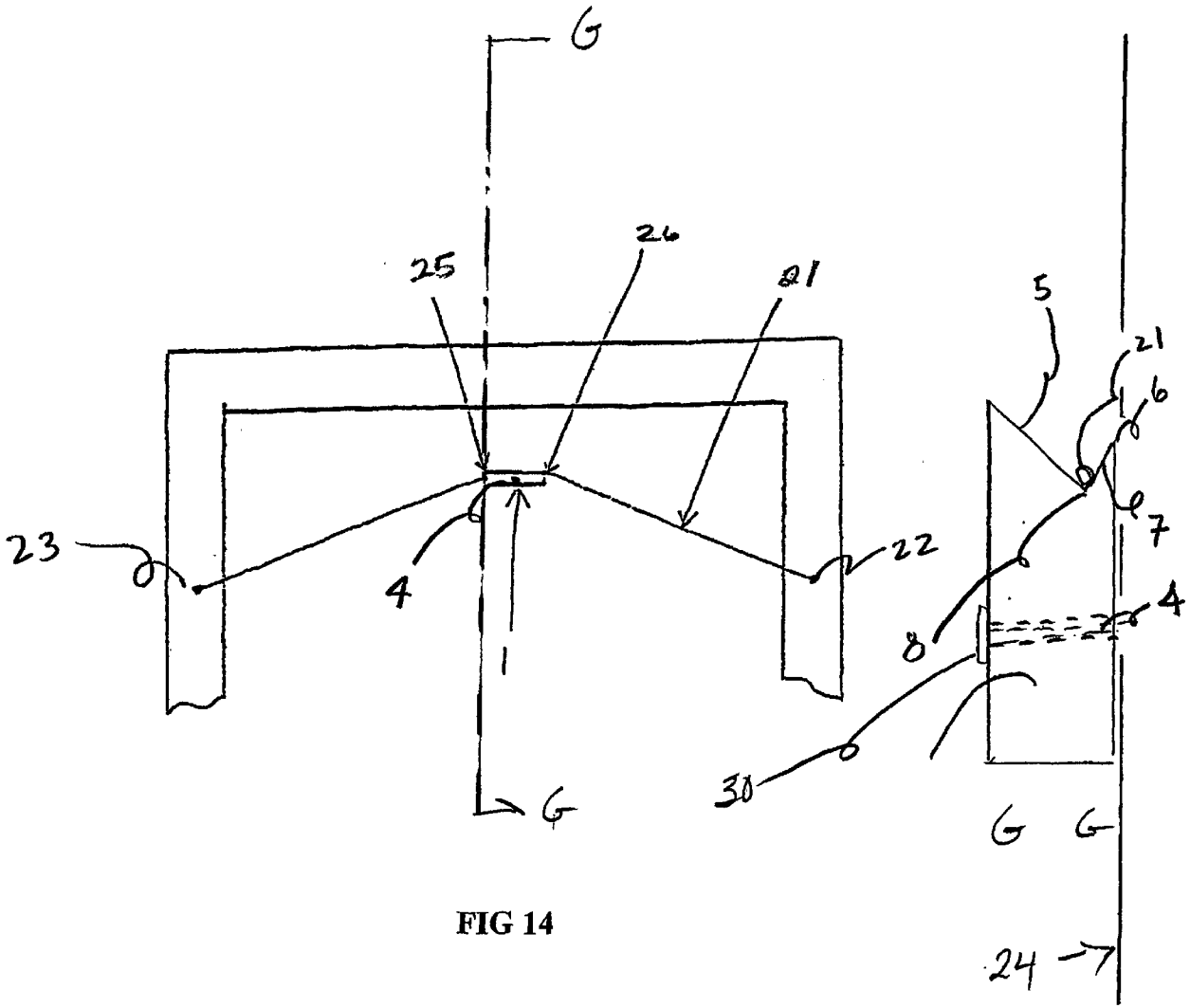
FIG. 14 shows a front view and a cross section of a particular embodiment of a dual point hanger system.

A substantially identical interlocking second hanger (28) comprising a hanger body (1) having an edge with a beveled surface (5) can be mounted to the hanging surface (24) so that the orientation of the second hanger body can be pivotally adjusted relative to said hanging surface (24) as shown in FIG. 14. Mounting the second hanger (28) can comprise use of the mechanical fastener interpenetration element (4). Mechanical fasteners responsive to the mechanical fastener interpenetration element (4) can be a screw, although other types of mechanical fasteners can be used as discussed above. The first hanger and the second hanger could also be mounted so that the first hanger is mounted to the hanging surface and the second hanger mounted to the object surface. Either approach can be effective. Once the first hanger (27) and the second hanger (28) are mounted to their respective surfaces, the hanger body edges having a beveled surface (5) can be interlocked.

The three point hanger system can further comprise a lateral adjustment projection (14) which travels between the pair of lateral adjustment stops (18) when the first hanger and the second hanger are interlocked. The three point hanger system can further comprise at least one compression element (6) coupled to the beveled surface (5) of both the first hanger (27) the second hanger (28). In the three point hanging system, when the first hanger and the second hanger are interlocked the compression elements (6) serve to compress against the inclined strike surface (7) of the other interlocked hanger as previously discussed. The compression element (6) can be continuous in certain embodiments of the invention, or can be a pair of compression elements in embodiments of the invention which have the lateral adjustment projection (17) and lateral adjustment stops (18). Friction augmentation elements (20) can be further included in either the first or the second hanger. As shown in FIG. 15, the mechanical fastener interpenetration elements can further comprise fastener recess elements (19).

Figure 16:
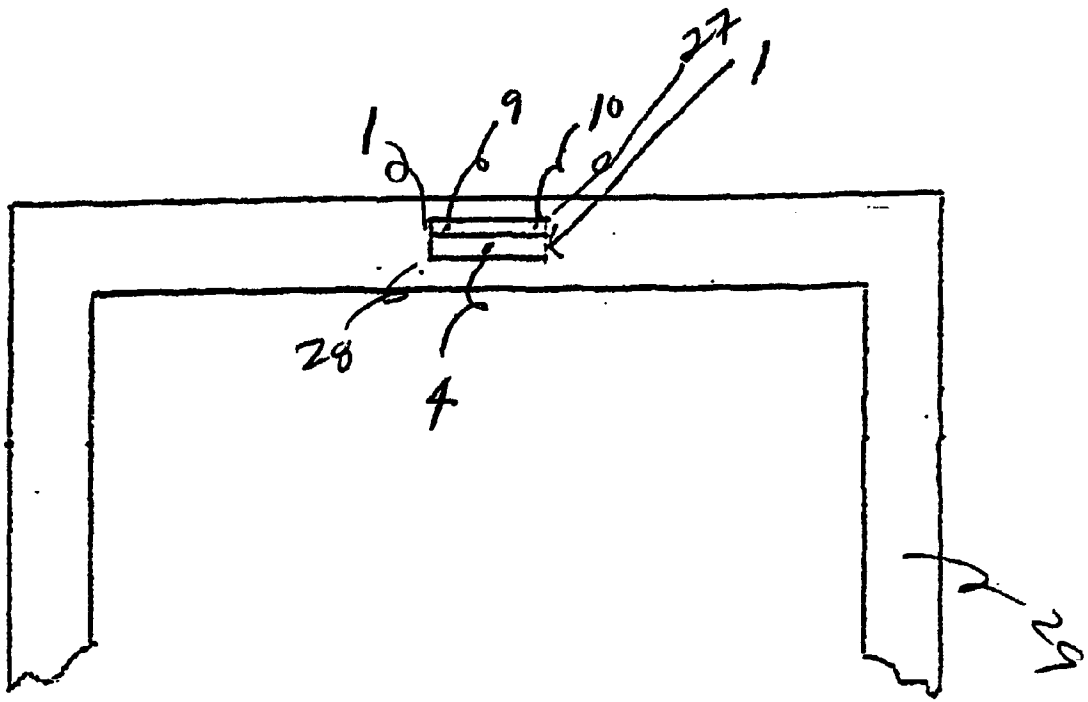
FIG. 16 shows a particular embodiment of a three point hanger system.
Figure 17:
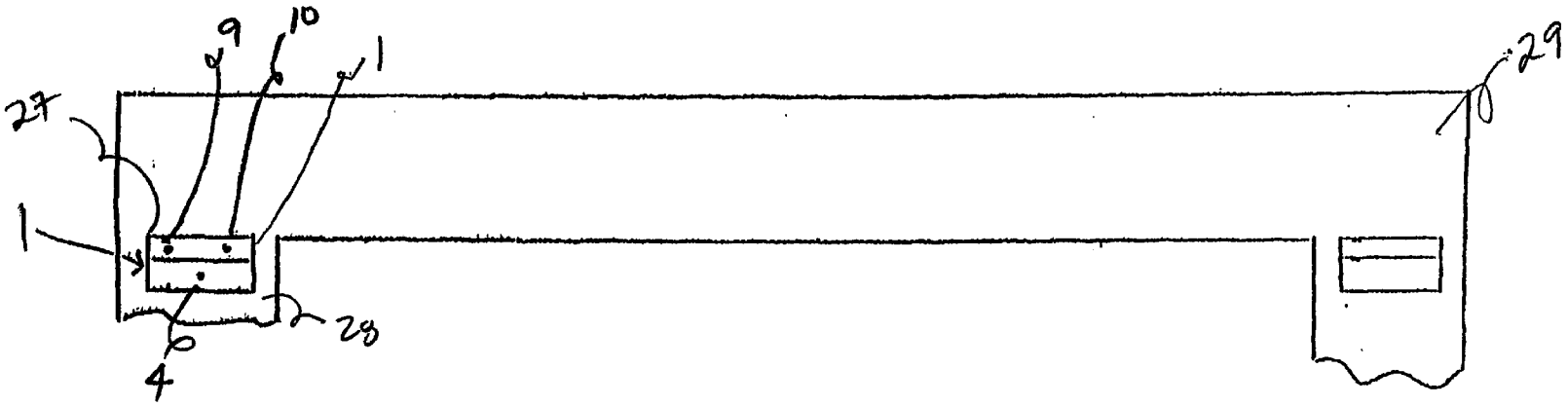
FIG. 17 shows a particular embodiment of a three point hanger system using two pair of interlocking hangers.

Now referring to FIGS. 16 and 17, the three point hanger system is illustrated with respect to hanging a conventional frame (naturally numerous types of objects could be hung with the three point hanger system). In FIG. 16, a first hanger (27) can be mounted to the top of the frame (29) and the second hanger (28) can he mounted to the hanging surface (24). In FIG. 17, two first hangers are mounted one on either side of a convention frame. Two second hangers (28) are mounted to the hanging surface. This approach may be used if desired, or may be necessary if an object is particularly large. A benefit of the three point hanger system with respect to large objects can be the elimination of wire-like suspension elements (21). When wire-like suspension elements (21) are used with larger objects, the objects tend to lean away from the wall. The three point hanger system invention using interlocking beveled surfaces (5) with compression elements (6) holds the object, framed item, picture, mirror, or the like snug to the hanging surface (24).

Figure 18:
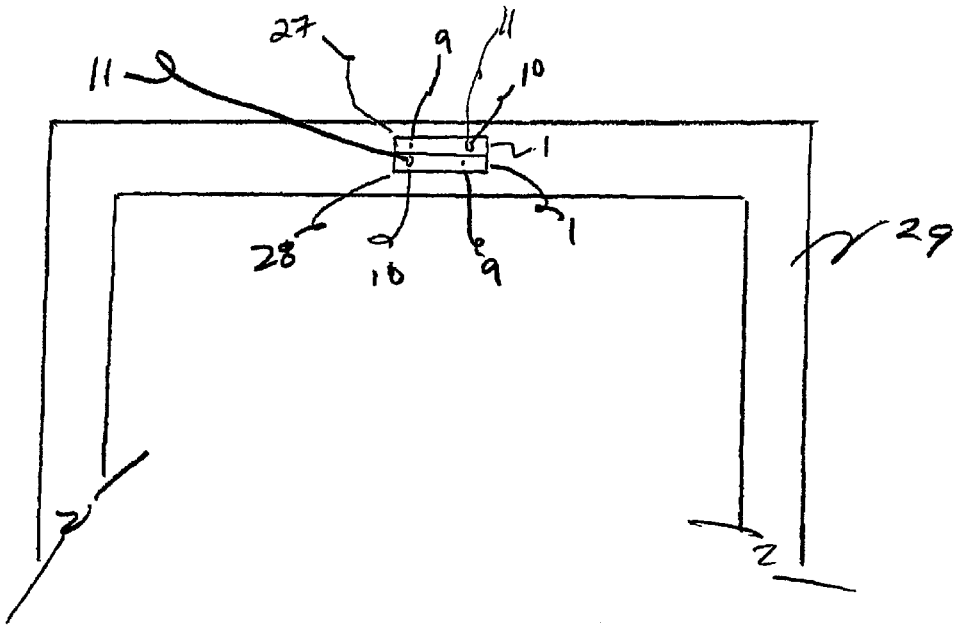
FIG. 18 shows a particular embodiment of a four point hanger system.

Four Point Hanger System. Now referring again to FIGS. 15 and 18, an embodiment of a four point hanger system invention is illustrated. Generally, the four point hanger system comprises a first hanger (27) that includes a first hanger body (1) having a front surface (2) and a back surface (3). A first mechanical interpenetration element (9) communicates between the front surface (2) and the back surface (3) and defines a rotation axis. A second mechanical interpenetration element (10) communicates between the front surface (2) and the back surface (3) of the hanger body (1) and can further provide a rotation adjustment element (11) coupled to the second mechanical interpenetration element (10).

At least one mechanical fastener can be responsive to each of the mechanical fastener interpenetration elements (9) (10) of the first hanger (27). The first hanger (27) can be mounted either to the object to be hung or to the hanging surface (24). The first hanger mounted to the object or the hanging surface (24) can be rotatably adjusted about the pivot axis defined by the first mechanical interpenetration element (9). The first hanger further includes a hanger body edge having a beveled surface (5).

The four point hanger system further comprises, a second hanger (28) that includes a second hanger body (1) having a front surface (2) and a back surface (3), a mechanical interpenetration element (9) between the front surface (2) and the back surface (3) that defines a rotation axis. A second mechanical interpenetration element (10) between the front surface (2) and the back surface (3) of the second hanger body (1) provides a rotation adjustment element (11) coupled to the second mechanical interpenetration element (10). At least one mechanical fastener can be responsive to each of the mechanical fastener interpenetration elements (9) (10) of the second hanger (28) so that the second hanger (27) can be mounted either to the object to be hung or to the hanging surface (24). The second hanger mounted to the object or the hanging surface (24) can be rotatably adjusted about the pivot axis defined by the first mechanical interpenetration element (9) similar to the first hanger. The second hanger further includes a hanger body edge having a beveled surface (5). The first hanger (27) and the second hanger (28) are interlocked to hang the object (29) to the hanging surface (24).

The four point hanger system invention can also include a lateral adjustment projection (17) coupled to the beveled surface (5) of the first hanger (27) which travels between a pair of lateral adjustment stops (18) coupled to the beveled surface (5) of the second hanger (28). The combination of the rotation adjustment element (11) and the lateral adjustment projection (17) allows the object to be rotationally and laterally adjusted with respect to the hanging surface. Because each hanger can be pivotally adjusted the rotational adjustment of the object relative to the hanging surface (24) can be substantial (exceeding 20 degrees with respect to some embodiments of the invention).

The object can resist movement from the desired orientation with respect to the hanging surface by coupling at least one compression element (6) to the beveled surface (5) of the first hanger (27) and at least one compression element (6) to the beveled surface (5) of the second hanger (28). As discussed, the compression element (6) can be continuous or comprise a pair of compression elements as shown in FIGS. 1 and 15. The compression element may further comprise an inclined surface (7) to mate with the inclined strike surface (12).

Any or all of the mechanical fastener interpenetration elements (9)(10) can have mechanical fastener recess elements (19). A friction augmentation surface may be coupled to the back side (3) of either the first hanger (27) or the second hanger (28).

Figure 19:
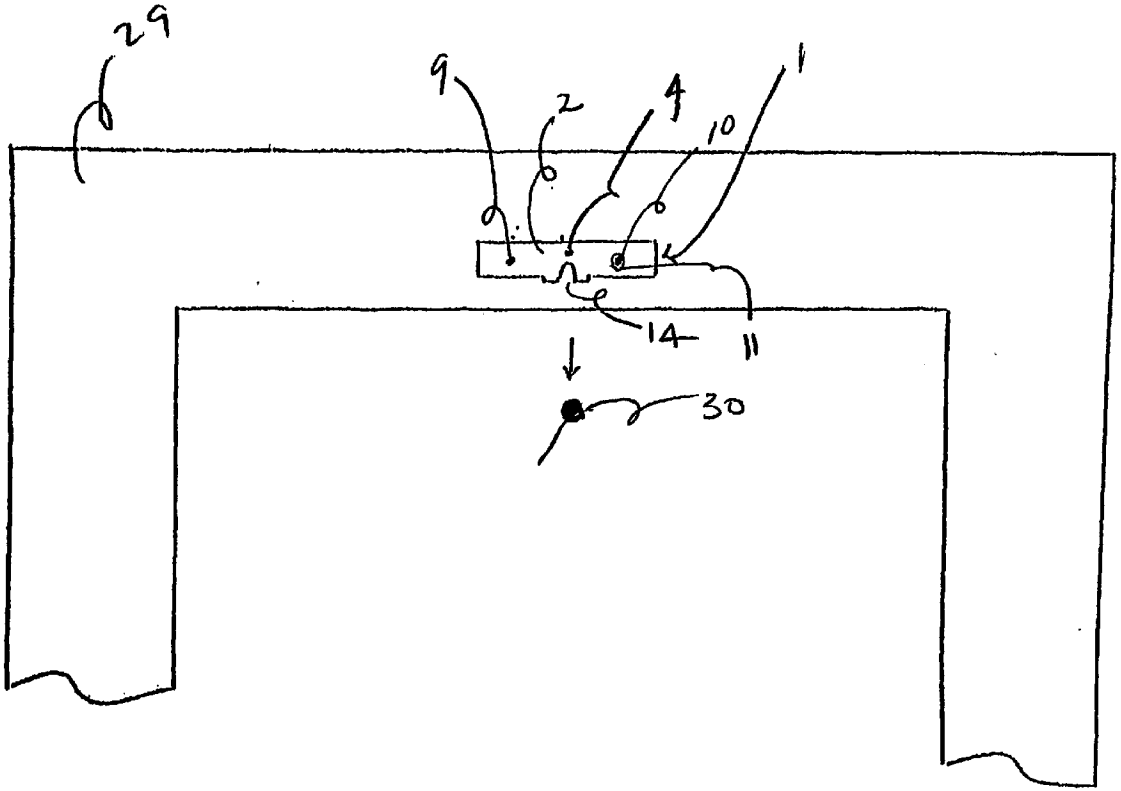
FIG. 19 shows a particular embodiment of a modified three point hanger system.
Figure 20:
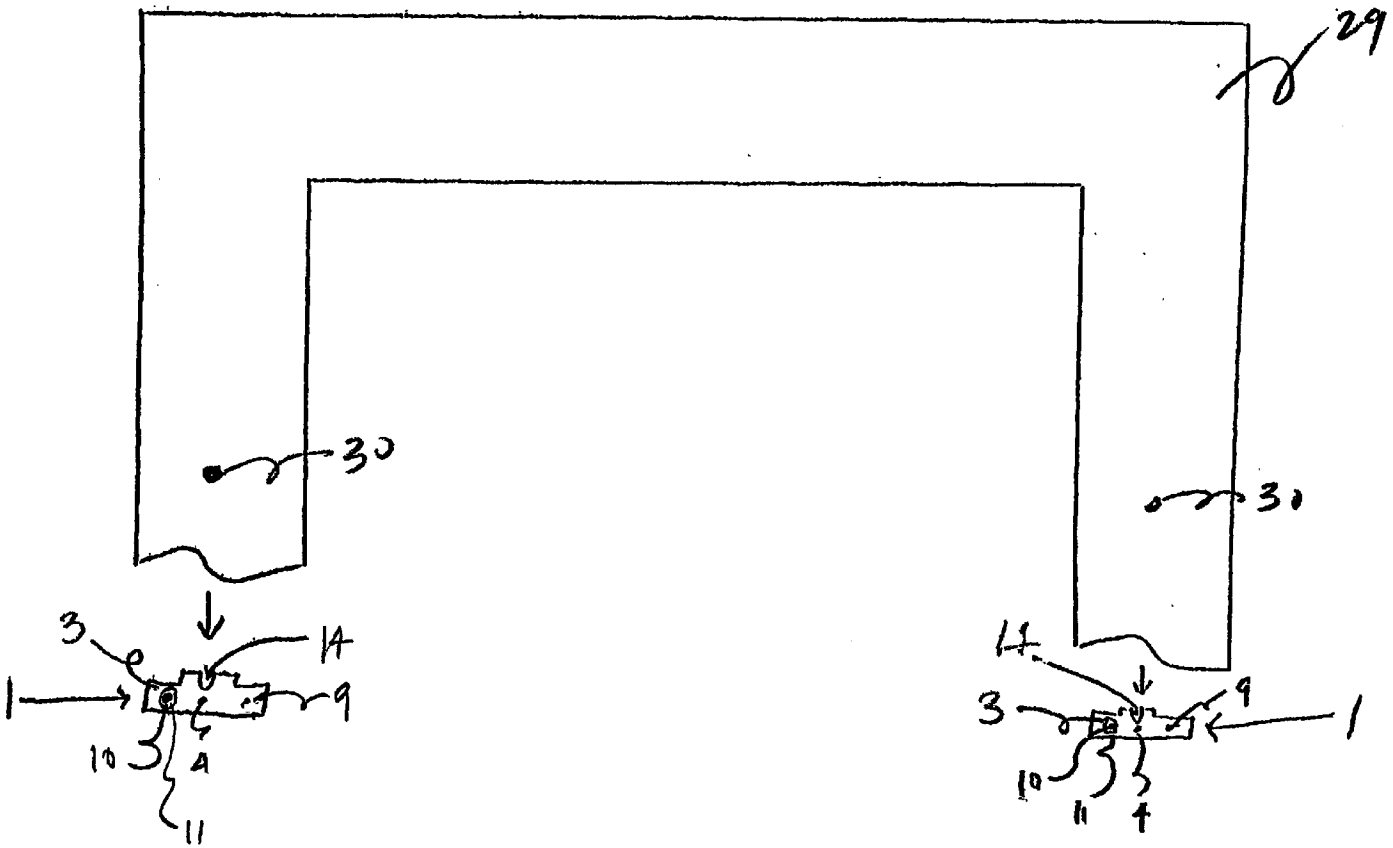
FIG. 20 shows a particular embodiment of a modified three point hanger system using two hangers.

Modified Three Point Hanger System. Now referring to FIGS. 19 and 20, a modified three point hanger system is illustrated. The basic embodiment of this invention comprises a single hanger body (1) having a front surface (2) and a back surface (3). A mechanical fastener securement element (14) is coupled to the hanger body edge. At least one mechanical fastener interpenetration element (4) can be used to mount the hanger body (1) to the object surface, such as the frame (20) shown in FIG. 19. Alternately mechanical fastener interpenetration elements (9)(10) can be used to mount the object if desired. A rotation adjustment element (11) can be coupled to either of the mechanical fastener interpenetration elements (9)(10) to allow for rotational adjustment of the object relative to the hanging surface. A mechanical fastener (30) having a head of larger diameter than the shaft or body can be set into the hanging surface. The body or shaft of the mechanical fastener can then be guided into the open perimeter of the interpenetration (15) and the head can then be located in recess (16). The diameter of the head of the mechanical fastener can selected so that it is too large to pull through the closed perimeter of interpenetration (15) and in that manner is held within recess (16). As shown by FIG. 20, the modified three point hanger system can be used with two hanger bodies to hang larger objects. Also as shown by FIG. 20, mechanical faster (30) can be set into the object to be hung and the hanger body (1) mounted to the hanging surface.

Figure 21:
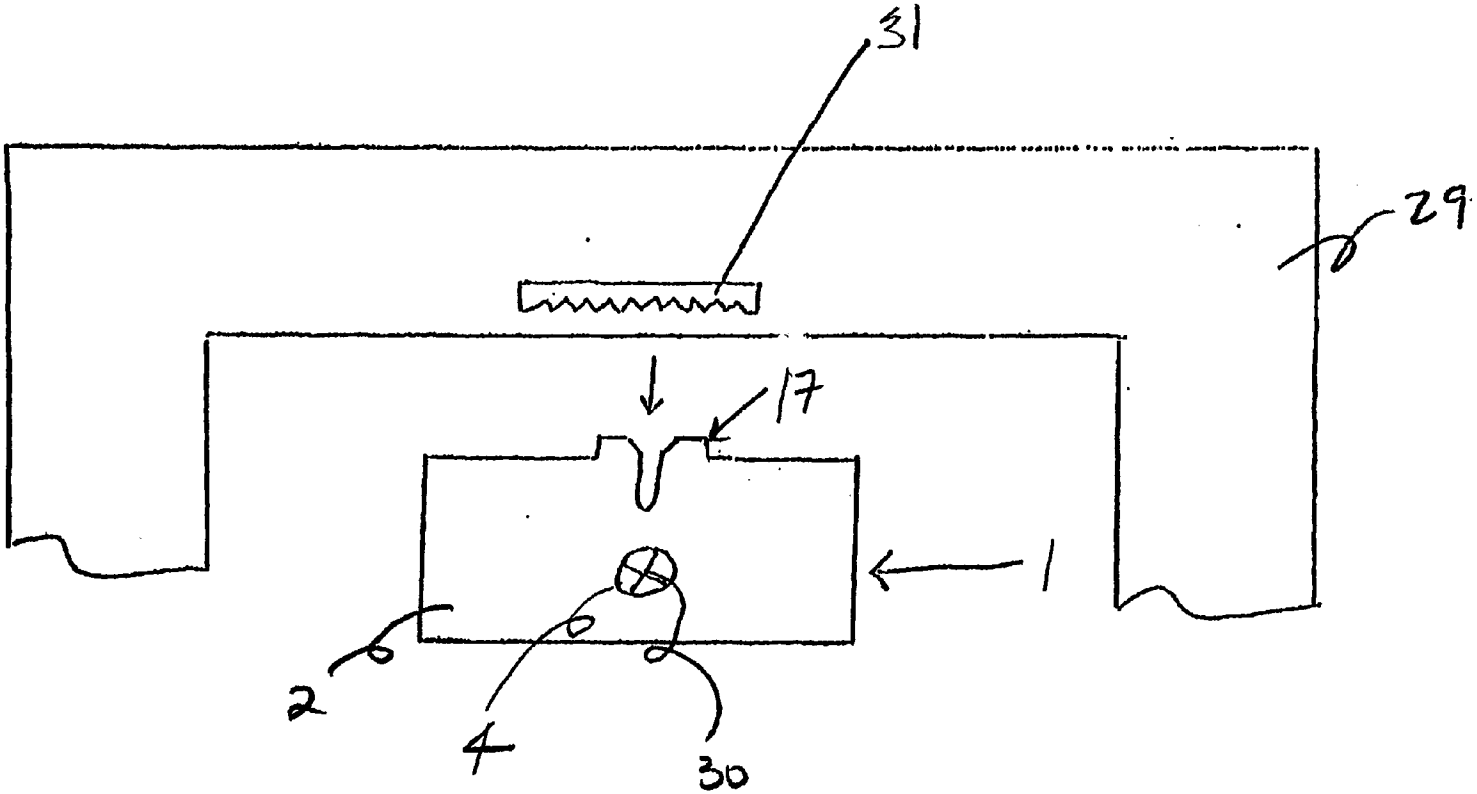
FIG. 21 shows a particular embodiment of a modified saw-tooth hanger system.
Figure 22:
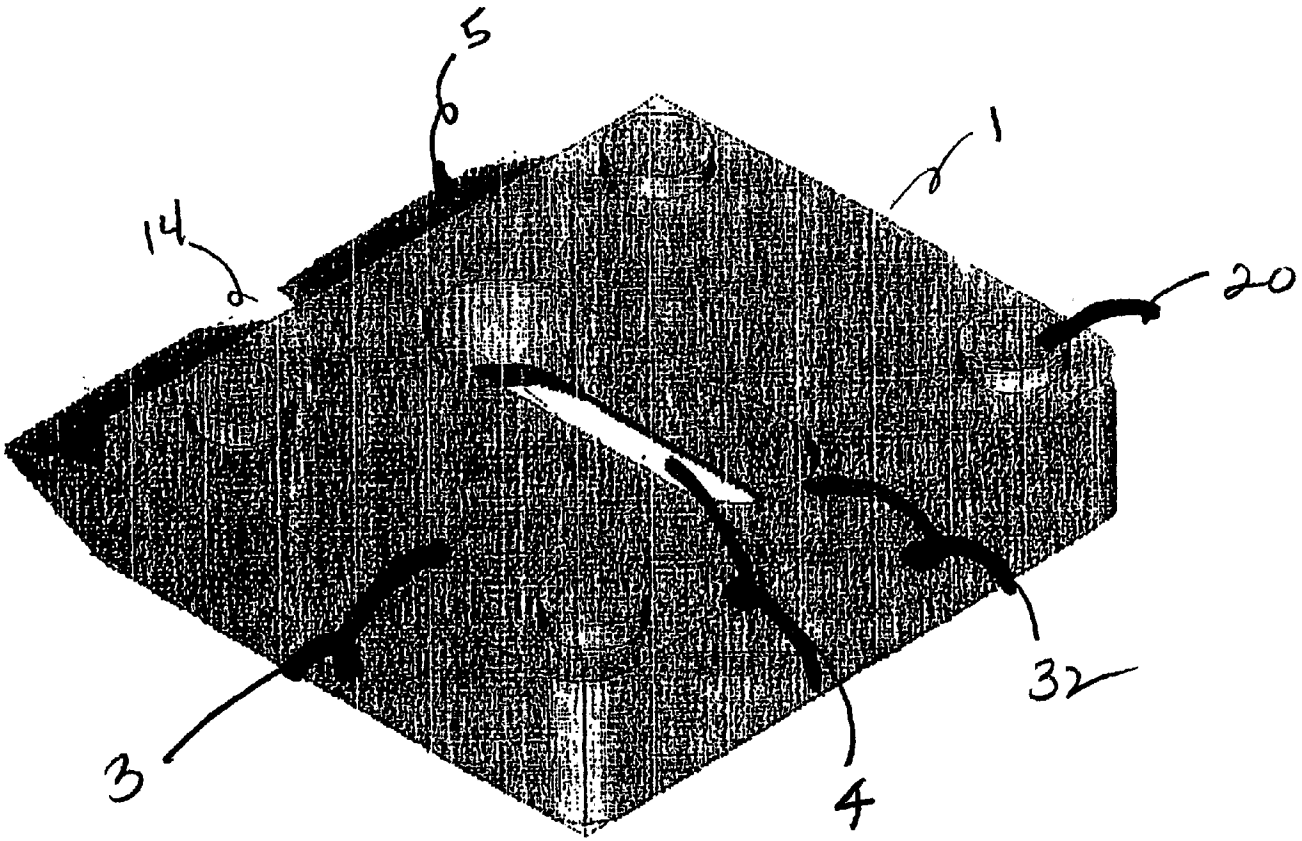
FIG. 22 shows a perspective of the backs side of particular embodiment of the invention having a vertical adjustment element.
Figure 23:
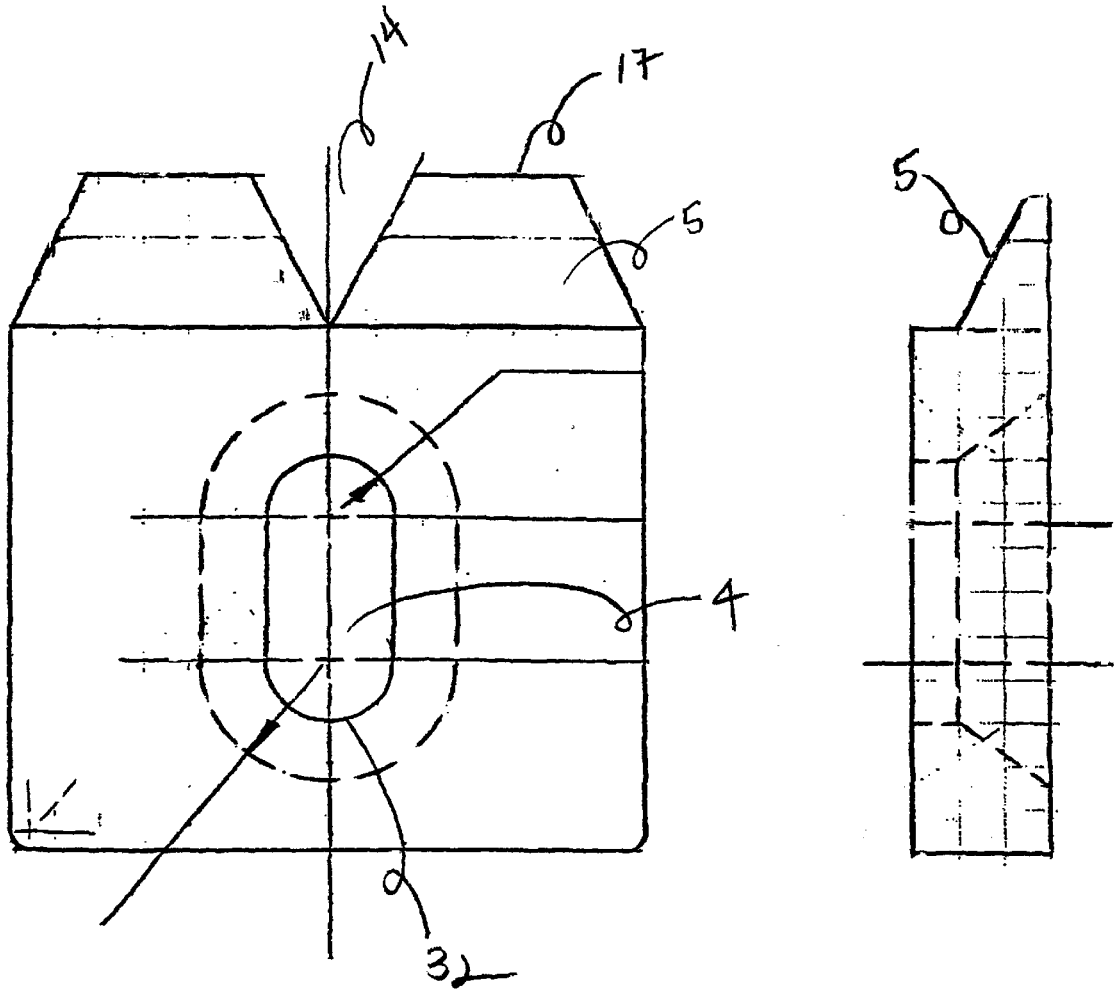
FIG. 23 shows a front view and a side view of a particular embodiment of the invention having a vertical adjustment element.

Modified Saw-Tooth Hanger System. Now referring to FIGS. 21–23, a modified sawtooth hanger system is illustrated. Conventional saw tooth hangers are encompassed in the single point hanging system discussed above. Conventionally, a mechanical fastener, such as a nail or a screw is set in the hanging surface and the saw tooth (31) may be mounted to the object to be hung, such as a frame (29). The saw tooth is then conventionally positioned onto the mechanical fastener. The object then swings freely on the mechanical fastener. As such, a saw tooth hanger can have all the problems of a single point hanger system as discussed above. As shown by FIG. 21, the modified sawtooth hanger system can comprise a hanger body (1) having a hanger body edge with a beveled surface (5), at least one mechanical fastener interpenetration element (4), and a lateral adjustment projection (17). In the modified sawtooth hanger system, the sawtooth can be conventionally mounted to the object and the sawtooth hanger system invention can be mounted to the hanging surface with a mechanical fastener (30) that is responsive to the mechanical fastener interpenetration element (4). The sawtooth is then positioned onto the lateral adjustment element (17) and pulled down on the beveled surface (5) fixing the object relative to the hanger body (1). The hanger can then be adjusted about the rotation axis provided by mechanical fastener (30). FIGS. 22 and 23 show another embodiment of the modified sawtooth hanger system invention. This embodiment of the sawtooth hanger system invention further includes a vertical adjustment element (32) coupled to mechanical interpenetration element (4).

It should be understood that a variety of changes may be made without departing form the essence of the invention Such changes are also implicitly included in the description. They still fall within the scope of this invention. In addition, each of the various elements of the invention and claims may also be achieved in a variety of manners. This disclosure should be understood to encompass each such variation, be it a variation of an embodiment of any apparatus embodiment, a method or process embodiment, or even merely a variation of any elements of these. Particularly, it should be understood that as the disclosed relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled As but one example, it should be understood that all action may be expressed as a means for taking that action or as an element which causes that action. Similarly, each physical element disclosed should be understood to encompass a disclosure of the action which that physical element facilitates. Regarding this last aspect, the disclosure of a "hanger" should be understood to encompass disclosure of the act of "hanging"—whether explicitly discussed or not—and, conversely, were there only disclosure of the act of "hanging", such a disclosure should be understood to encompass disclosure of a "hanger" and even a means for "hanging." Such changes and alternative terms are to be understood to be explicitly included in the description.

Any acts of law, statutes, regulations, or rules mentioned in this application for patent; or patents, publications, or other references mentioned in this application for patent are hereby incorporated by reference. Specifically, U.S. Provision Application No. 60/191,993 is hereby incorporated by reference including any figures or attachments, and each of references in the following table of references are hereby incorporated by references.

| DOCUMENT NO. | DATE | NAME | CLASS | SUBCLASS | FILING DATE |
|---|---|---|---|---|---|
| 275,730 | Oct. 02, 1984 | Melley | D8 | 373 | Sep. 02, 1982 |
| 361,260 | Sep. 15, 1995 | Trentham | D8 | 354 | Mar. 28, 1994 |
| 3,861,639 | Jan. 21, 1975 | Morrill | 248 | 489 | Sep. 26, 1973 |
| 3,955,790 | May 11, 1976 | Ballin | 248 | 489 | Sep. 12, 1974 |
| 3,982,719 | Sep. 28, 1976 | Kilborne | 248 | 489 | Nov. 28, 1975 |
| 4,026,510 | May 31, 1977 | Holmes | 248 | 493 | May 17, 1976 |
| 4,069,998 | Jan. 24, 1978 | Rytting | 248 | 476 | Oct. 26, 1976 |
| 4,171,117 | Jan. 16, 1979 | Prochaska | 248 | 495 | Apr. 10, 1978 |
| 4,244,549 | Jan. 13, 1981 | Oldfield | 248 | 494 | May 05, 1978 |
| 4,333,625 | Jun. 08, 1982 | Haug | 248 | 216.1 | Feb. 21, 1980 |
| 4,384,648 | May 24, 1983 | Hart et al. | 206 | 527 | Apr. 05, 1982 |
| 4,641,807 | Feb. 10, 1987 | Phillips | 248 | 480 | Sep. 23, 1985 |
| 4,645,165 | Feb. 24, 1987 | Raap | 248 | 476 | Jul. 24, 1985 |
| 4,775,129 | Oct. 04, 1988 | Gleisten | 248 | 493 | Feb. 24, 1987 |
| 4,883,247 | Nov. 28, 1989 | Crandall | 248 | 542 | Jun. 27, 1988 |
| 5,048,788 | Sep. 17, 1991 | Lorincz | 248 | 477 | Aug. 31, 1989 |
| 5,069,411 | Dec. 03, 1991 | Murphy | 248 | 476 | Oct. 10, 1990 |
| 5,069,412 | Dec. 03, 1991 | Jacob | 248 | 493 | May 10, 1991 |
| 5,443,238 | Aug. 22, 1995 | Mitchell | 248 | 498 | Feb. 09, 1994 |
| 5,507,462 | Apr. 16, 1996 | Hickey | 248 | 489 | Feb. 06, 1995 |
| 5,791,625 | Aug. 11, 1998 | Orser | 248 | 495 | Dec. 31, 1996 |
| 5,906,349 | May 25, 1999 | Roy | 248 | 489 | Aug. 13, 1997 |
| 5,947,438 | Sep. 07, 1999 | Lemire | 248 | 476 | Feb. 12, 1998 |

In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference.

Thus, the applicant(s) should be understood to claim at least: i) hanger devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, and ix) methods and apparatuses substantially as described hereinbefore and with reference to any of the accompanying examples, and x) the various combinations and permutations of each of the elements disclosed.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

I claim:

1. An object hanger, comprising:

a. a hanger body having a front surface and a back surface;

b. a mechanical fastener interpenetration element between said front surface and said back surface of said hanger body;

c. a hanger body edge having a beveled surface; and d. at least one compression element connected to said beveled surface.

e. wherein said compression element further comprises an inclined surface.

2. An object hanger as described in claim 1, wherein said compression element comprises a continuous compression element coupled to said beveled surface.

3. An object hanger as described in claim 1, wherein said compression element comprises a pair of compression elements coupled to said beveled surface.

4. An object hanger as described in claim 1, further comprising a compression groove having a location defined by the intersection of said beveled surface and said compression element.

5. An object hanger as described in claim 1, further comprising;

a. a second mechanical fastener interpenetration element between said front surface and said back surface, wherein said second mechanical fastener interpenetration element defines a rotation axis; and b. a third mechanical fastener interpenetration element, wherein said third mechanical interpenetration element further comprises a rotation adjustment element.

6. An object hanger as described in claim 1, further comprising an inclined strike surface, wherein the plane of said inclined strike surface intersects said front surface and said beveled surface.

7. An object hanger as described in claim 6, wherein said inclined strike surface further comprises at least one mechanical fastener interpenetration element.

8. An object hanger as described in claim 1, further comprising a mechanical fastener securement element, wherein an interpenetration between said front surface and said back surface of said hanger body has a perimeter open at a location along said beveled surface of said hanger body, and wherein back side of said hanger body has a recess substantially aligned with said interpenetration, and wherein said recess has a perimeter open at a location along said beveled surface.

9. An object hanger as described in claim 8, further comprising a lateral adjustment projection coupled to said beveled surface of said hanger body.

10. An object hanger as described in claim 9, further comprising a pair of lateral adjustment stops coupled to said beveled surface.

11. A method of making an object hanger, comprising the steps of:

a. providing a hanger body;

b. interpenetrating said hanger body between said front surface and said back surface at a first location;

c. beveling an edge of said hanger body surface; and d. connecting a compression element to said beveled surface.

e. connecting a compression element having an inclined surface to said beveled surface.

12. A method of making an object hanger as described in step 11, further comprising the steps of:

a. interpenetrating said hanger body between said front surface and said second surface at a second location;

b. interpenetrating said hanger body between said front surface and said second surface at a third location; and c. coupling a rotation adjustment element to an interpenetration at said third location.

13. A method of making an object hanger as described in step 11, further comprising the step of providing an inclined striking surface, wherein said inclined striking surface intersects said front surface and said beveled surface.

14. A method of making an object hanger as described in step 11, further comprising the step of coupling a mechanical fastener securement element.

15. A method of making an object hanger as described in step 11, further comprising the step of coupling a lateral adjustment projection.

16. A method of making an object hanger as described in step 15, further comprising the step of providing a pair of lateral adjustment stops.

17. A method of hanging an object, comprising the steps of:

a. rotationally mounting a hanger body to a mounting surface, wherein said hanger body has a beveled edge connected to at least one compression element;

b. fastening the ends of a suspension element to an object;

c. positioning said suspension element between the surface of said beveled edge and the surface of said compression element;

d. compressing said suspension element between the surface of said beveled edge and the surface of said compression element to maintain the position of said suspension element; and e. rotating said hanger body to adjust the position of said object relative to said mounting surface.

* * * * *